US011428488B2

(12) United States Patent
Todd, II et al.

(10) Patent No.: US 11,428,488 B2
(45) **Date of Patent: *Aug. 30, 2022**

(54) FIREARM SAFING ASSEMBLIES AND FIREARMS INCLUDING THE SAME

(71) Applicant: DeWalch FM, LLC, Houston, TX (US)

(72) Inventors: Tyler Dean Todd, II, Houston, TX (US); Norman Binz DeWalch, Houston, TX (US)

(73) Assignee: DEWALCH FM, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/948,214

(22) Filed: Sep. 9, 2020

(65) Prior Publication Data

US 2021/0131757 A1 May 6, 2021

Related U.S. Application Data

(63) Continuation of application No. 16/279,232, filed on Feb. 19, 2019, now Pat. No. 10,816,294.

(51) Int. Cl.

| | |
|---|---|
| ***F41F 1/10*** | (2006.01) |
| ***F41A 17/32*** | (2006.01) |
| ***F41A 19/68*** | (2006.01) |

(52) U.S. Cl.

CPC ..... *F41A 17/32* (2013.01); *F41A 19/68* (2013.01); *F41F 1/10* (2013.01)

(58) Field of Classification Search

CPC .. F41A 17/32; F41A 19/68; F41A 9/36; F41A 3/26; F41A 7/10; F41A 13/06; F41F 1/10

USPC ..... 89/12, 13.05, 127; 42/16, 70.01

See application file for complete search history.

(56) References Cited

U.S. PATENT DOCUMENTS

| | | | | |
|---|---|---|---|---|
| 3,611,866 A | | 10/1971 | Jacolucci et al. | |
| 3,766,821 A | * | 10/1973 | Cozzy | F41F 1/10 89/149 |
| 6,742,434 B1 | | 6/2004 | Dillon | |
| 7,013,789 B2 | | 3/2006 | Dillon | |
| 7,703,374 B1 | | 4/2010 | Dillon | |
| 2006/0207418 A1 | * | 9/2006 | Burke | F41A 7/10 89/12 |
| 2008/0092726 A1 | * | 4/2008 | Dillon | F41A 13/06 89/12 |

* cited by examiner

*Primary Examiner* — Michael D David

(74) *Attorney, Agent, or Firm* — Grossman, Tucker, Perreault & Pfleger, PLLC

(57) ABSTRACT

Firearm safing assemblies and firearms including the same are disclosed. In embodiments firearm safing assemblies include a safing sector with a track surface and a receiver door track. The receiver door track may couple to a receiver of a rotatable firearm, wherein the receiver includes a bolt track and at least a portion of the receiver extends coaxially about a first axis. The safing sector is configured to be at least partially disposed within the receiver door track and to move between a safe position and an armed position. In the safe position the track surface is out of alignment with and does not form part of the bolt track, whereas in the armed position it is aligned with and forms part of the bolt track.

20 Claims, 20 Drawing Sheets

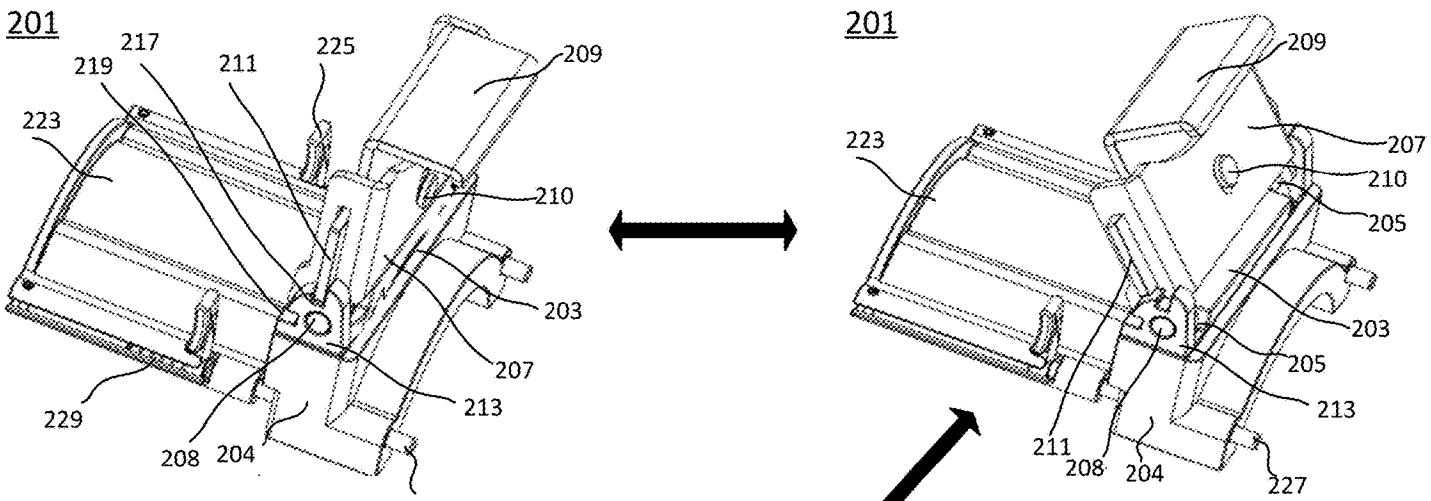
FIG. 3A
SAFE
FIG. 3B
INTERMEDIATE
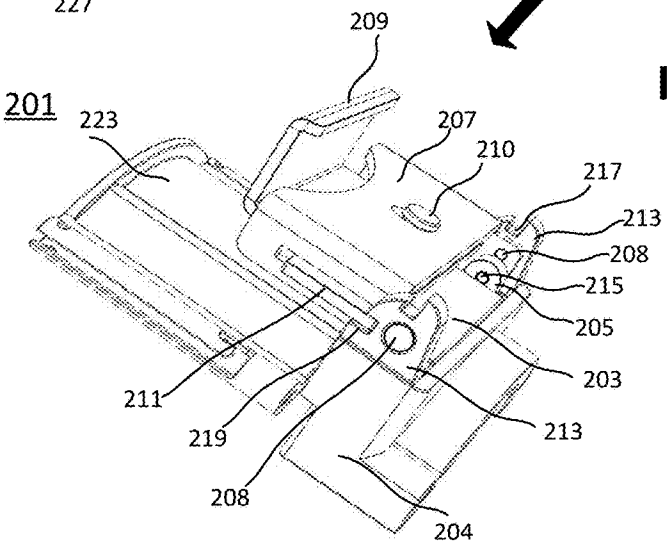
FIG. 3C
ARMED

Section C-C

Section E-E

Section F-F

FIREARM SAFING ASSEMBLIES AND FIREARMS INCLUDING THE SAME

CROSS-REFERENCE TO RELATED APPLICATIONS

This application is a continuation of U.S. patent application Ser. No. 16/279,232, filed Feb. 19, 2019, the entire content of which is incorporated herein by reference.

TECHNICAL FIELD

The present disclosure generally relates to firearm safing assemblies and, more particularly, to firearm safing assemblies for use with a rotatable firearm. Firearms including such safing assemblies are also described.

BACKGROUND

The "Gatling gun" is a firearm that was originally developed in the mid-nineteenth century, and is a multiple barrel firearm that includes a plurality of barrels (e.g., six). In operation, the Gatling gun fires projectiles in an automatic fashion as the plurality of barrels rotate in a circuit about an axis. As they rotate the barrels consecutively move to a single armed position that allows for the firing of a projectile. After a projectile is fired from one barrel, that barrel continues to rotate, bringing the next barrel to the armed position. Thus, each of the barrels fires only a portion of the projectiles that are shot by the firearm. Over time many improvements have been made to the original Gatling gun, advancing the design of the gun from a crank driven design to the design used in the modern M-134 "minigun." Despite many improvements made over the years, the M-134 has retained the multiple rotating barrel design that is a hallmark of this type of firearm.

Like many firearms the M-134 utilizes cartridge ammunition. Cartridge ammunition generally includes a projectile (e.g., a bullet) that is mounted over an explosive charge. The bullet and charge are held together by a casing that includes an explosive primer. In many modern firearms the primer is designed to ignite in response to a force imparted from a firing pin, which may reside within a firearm bolt. Ignition of the primer is transferred to the charge, causing the charge to detonate and launch the bullet (e.g., through a barrel). In some cases, such as in the M-134, the bolt is also designed to eject spent cartridges from the firearm and chamber the next cartridge.

In firearms that include multiple rotating barrels such as the M-134, each barrel is typically associated with its own bolt. Such bolts often include a head and a body that is movable relative to the head. Common bolt designs that are used in the M-134 include the bolt described in U.S. Pat. No. 3,611,866 (hereinafter, the "GE bolt") and the bolt described in U.S. Pat. No. 6,742,434 (hereinafter, the "Dillon bolt"). The structure and operation of the GE bolt and the Dillon bolt are described in detail in the '866 and '434 patents, the entire content of both of which are incorporated herein by reference. In general, the bolts used in a rotatable firearm such as the M-134 include a firing pin that is cocked and released as the bolt moves within a (helical) bolt track within a receiver of the firearm. More particularly, as the bolt is rotated a cam bearing coupled to the bolt moves within the bolt track. As the bolt approaches the armed position, movement of the cam bearing within the bolt track causes the firing pin to compress (cock). When the bolt arrives at the armed position, the firing pin is released.

Like many other firearms, rotatable firearms such as the M-134 include a safety mechanism that is configured to prevent unintentional firing of ammunition. FIGS. 1A and 1B are perspective views of a minigun 100 (e.g. an M-134) that includes one example of a prior art safing sector assembly 1 in an armed position (FIG. 1A) and a safe position (FIG. 1B). As shown, safing sector assembly 1 is externally attached to a main housing of a receiver of minigun 100 via a pin 15 and one or more tabs 5. To move the safing sector assembly 1 from the armed position (FIG. 1A) to the safe position (FIG. 1B), tabs 5 are compressed towards one another, which allows the safing sector assembly 1 to be rotated about an axis A (extending through pin 15) and outward and away from the main housing of the receiver. Conversely, to move from the safe position to the armed position the safing sector assembly 1 is rotated about axis A and inward and toward the main housing of the receiver, until tabs 5 are engaged within a corresponding slot within the safing sector assembly 1.

Notably when safing sector assembly 1 is in the armed position (FIG. 1A), it forms a portion of the (helical) bolt track that is used to drive the bolt assemblies to and from an armed position. In contrast when safing sector assembly 1 is in the safe position (FIG. 1B), the portion of the bolt track formed by the safing sector assembly 1 rotated about axis A until it is out of alignment with the remainder of the bolt track formed by the receiver. Consequently, cocking and discharge of the firing pin within the bolt assemblies used in minigun 100 cannot occur when the safing sector assembly is in the safe position.

While safing sector assembly 1 can effectively prevent unintended firing of minigun 100, it is not without some disadvantages. For example, and as shown in FIG. 1B, when safing sector assembly 1 is in the safe position, it hangs from pin 15 to one side of the firearm. It may therefore be difficult to observe that safing sector assembly 1 is in the safe position from the opposite side of minigun 100. This is undesirable, as users generally wish to know when a firearm is in a safe or armed condition. Safing sector assembly 1 may also catch on clothing and/or be susceptible to damage when it is in the safe position, as it hangs relatively unprotected to one side of the firearm. It may also be difficult for users of minigun 100 (who often wear gloves and other protective clothing) to operate safing sector assembly 1, particularly with one hand.

Thus, there remains a need in the art for firearm safing assemblies that address one or more of the above issues, while remaining compatible with existing rotatable firearm designs such as the M-134.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts, and in which:

FIG. 3A is a right perspective view of one example of a firearm safing assembly consistent with the present disclosure in a safe position;

FIG. 3B is a right perspective view of the example firearm safing assembly shown in FIG. 3A in an intermediate position;

FIG. 3C is a right perspective view of the example firearm safing assembly shown in FIGS. 3A and 3B in an armed position;

DETAILED DESCRIPTION

Figure 1A:
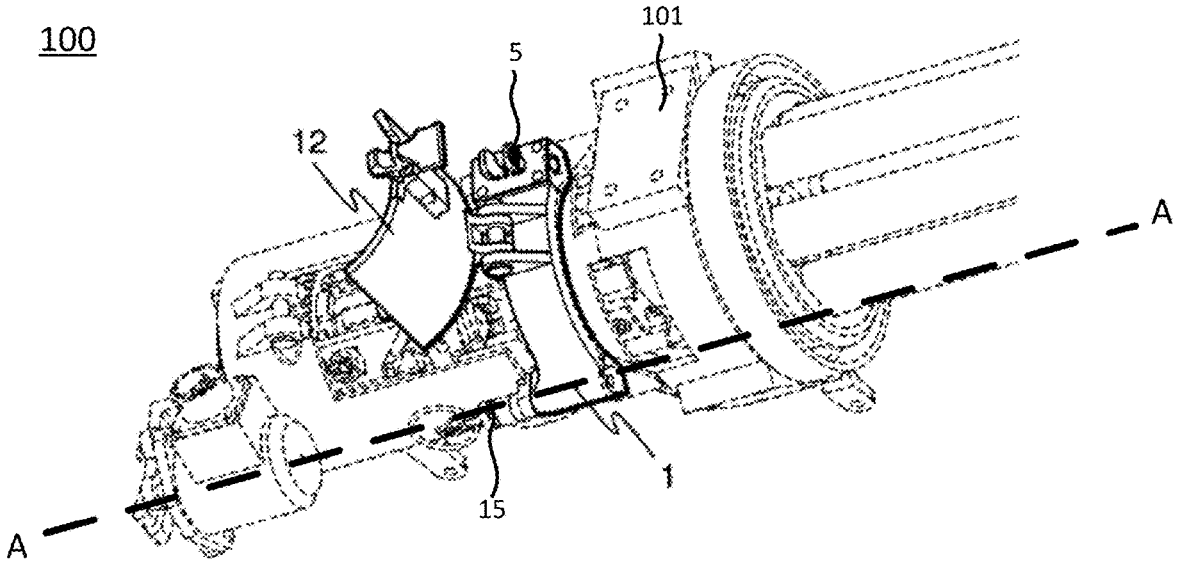
FIG. 1A PRIOR ART
FIG. 1A is a perspective view of a rotatable firearm including a safing sector assembly consistent with the prior art in an armed position.
Figure 1B:
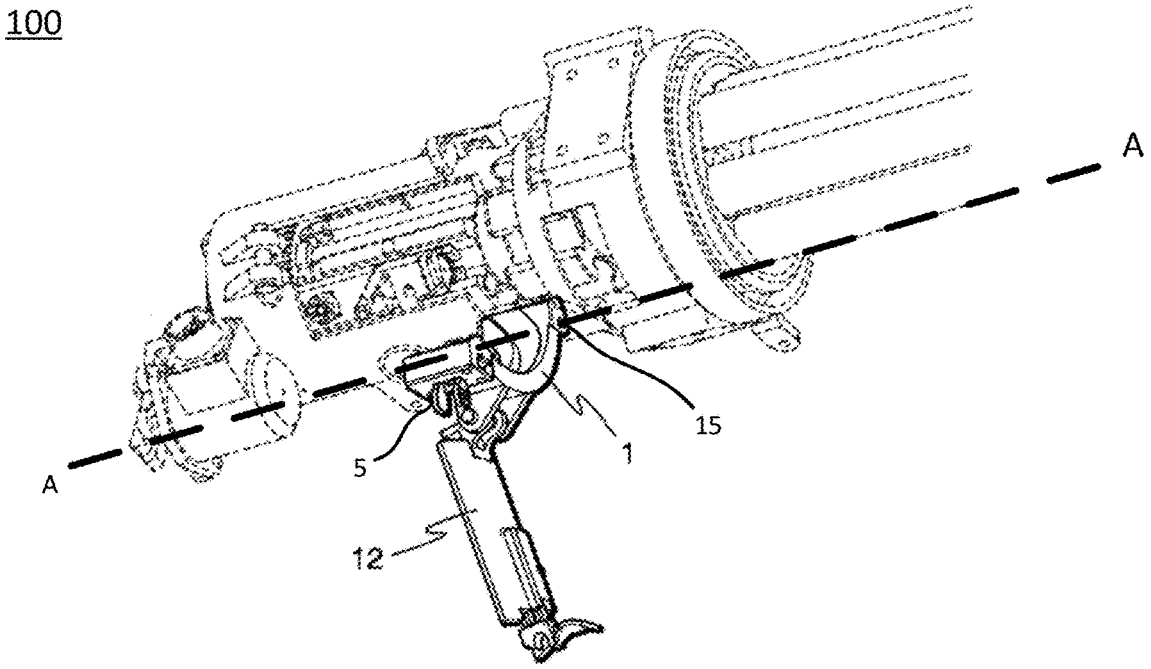
FIG. 1B PRIOR ART
FIG. 1B is a perspective view of a rotatable firearm including a safing sector assembly consistent with the prior art in a safe position.

As noted in the background, safety mechanisms such the safing sector assembly 1 shown in FIGS. 1A and 1B have been developed for use with rotatable firearms such as the M-134. While such safing mechanisms can effectively prevent the unintentional discharge of the firearm, they are not without some disadvantages. As noted above, the safing sector assembly 1 is configured to rotate about an axis A extending through a pin on the side of minigun 100 as the assembly is moved from an armed to a safe position. While safing sector assembly 1 is in the safe position (FIG. 1B), it may be difficult to see that minigun 100 is in a safe condition, particularly from the side of minigun 100 that is opposite the side on which safing sector assembly 1 hangs. Safing sector assembly 1 may also readily catch on clothing and/or be susceptible to damage while it is in the safe position. It may also be challenging for users of minigun 100 to operate safing sector assembly 1 with one hand, particularly if the user is wearing gloves. Thus, there remains a need and desire in the art for firearm safing assemblies that are simple to operate (particularly with one hand) and readily signal that that a firearm is in a safe or armed condition, yet which are compatible with existing firearm designs—particularly rotary firearm designs such as the M-134.

The present disclosure generally relates to firearm safing assemblies that differ from the safing sector assembly 1 shown in FIGS. 1A and 1B, yet remain compatible with existing firearm designs such as the M-134. The firearm safing assemblies described herein generally include a safing sector with an inward facing surface, a track surface, and a receiver door track. The receiver door track is generally configured to couple to a receiver of a rotatable firearm (e.g., of a minigun such as the M-134), wherein the receiver includes a (helical) bolt track and at least a portion of the receiver extends coaxially about a first axis. The safing sector is generally configured to be at least partially disposed within the receiver door track and to move between a safe position and an armed position. In the safe position the inward facing surface is disposed away from the first axis such that the track surface is out of alignment with and does not form part of the bolt track. In contrast in the armed position the inward facing is displaced toward the first axis such that the track surface is aligned with and forms part of the bolt track. During movement of the safing sector from the safe position to the armed position, the inward facing surface and track surface move substantially linearly in a first direction that is substantially perpendicular to the first axis. During movement of the safing sector from the armed position to the safe position, the inward facing surface and the track surface move substantially linearly in a second direction that is opposite or substantially opposite the first direction.

In embodiments the first axis extends through a center of an opening of the receiver. In those or other embodiments the receiver door track may include a cam guide, and the firearm safing assembly further includes a lever, a lever pin, and a safing cam that is coupled to the safing sector and the lever. The lever is coupled to the cam guide by the lever pin, such that the lever is rotatable about a second axis extending through the lever pin. The safing cam is configured to convert rotational movement of the lever about the second axis to linear movement of the safing sector relative to the first axis.

In embodiments the firearm safing assembly further includes a first cam pin and a second cam pin, wherein the safing cam is coupled to the lever by the first cam pin and the safing cam is coupled to the safing sector by the second cam pin. In those or other embodiments the safing sector further includes a camming surface that interacts with said safing cam as the safing sector is moved from the safe position to the armed position, and as the safing sector is moved from the armed position to the safe position.

In those or other embodiments the cam guide includes a first latch stop and a second latch stop and the firearm safing assembly further includes a latch handle coupled to the lever, wherein the latch handle includes a latch member. In such embodiments when the safing sector is in the safe position, at least a portion of the latch member is engaged within the first latch stop. In contrast when the safing sector is in the armed position, at least a portion of the latch member is engaged within the second latch stop. In such instances the firearm safing assembly may further include a handle spring that biases the latch member towards the first latch stop when the safing sector is in the safe position, and biases the latch member towards the second latch stop when the safing sector is in the armed position. In embodiments the lever includes a first handle pin slot, the latch handle includes a second handle pin slot, and the lever is coupled to the latch handle by a latch pin that extends at least partially through the first and second handle pin slots. The latch pin may be movable within the first pin slot to allow engagement and disengagement of the latch member from the first and second latch stops.

The receiver door track may further include a cover that is coupled to or is integral with the cam guide. In embodiments the cover is integral with the cam guide.

Machine guns including a firearm safing assembly consistent with the present disclosure are also described. In embodiments the machine gun is a rotatable firearm, such as but not limited to a minigun such as the M-134. In any case the machine gun includes a receiver that includes a bolt track, wherein at least a portion of the receiver extends coaxially about a first axis. In embodiments the first axis extends through an opening of the receiver. The machine gun may further include a firearm safing assembly that includes a receiver door track that is coupled to the receiver.

As used herein, the phrase "substantially linearly" when used regarding movement of a component relative to (e.g., perpendicular to) an axis means that the principal movement of the component is linear with respect to the indicated axis, where "principal movement" means that greater than or equal to about 90%, greater than or equal to about 95%, or even greater than or equal to about 99% is linear in an indicated direction relative to the indicated axis. Accordingly, an indication that a "component moves substantially linearly in a first direction that is substantially perpendicular to a first axis" means that greater than or equal to about 90% (≥about 95% or even ≥about 99%) of the movement of the component is linear in the first direction that is substantially perpendicular to the first axis. Put in different terms, the phrase "substantially linearly" is used to indicate movement that is principally linear in nature, yet encompasses relatively small amounts of non-linear movement that may be reasonably expected within nominal machine tolerances.

As used herein, the term "substantially opposite" means opposite or nearly opposite (e.g., opposite within a +/−30% deviation tolerance, such as a +/−20%, +/−10%, or even+/−5% deviation tolerance). In embodiments "substantially opposite" means opposite or nearly opposite within a +/−5% deviation tolerance.

As used herein, the term "safe position" is used to refer to a position of a safing sector that does not permit firing of projectiles from a firearm. In embodiments the safe position is a position at which a track surface of a safing sector is sufficiently out of alignment with a bolt track of a firearm that firing of projectiles from the firearm is prevented. Put in different terms, in the safe position the track surface of the safing sector does not form part of a bolt track of the firearm. In contrast the term "armed position" is used herein to refer to a position of a safing sector that permits firing of projectiles from a firearm. In embodiments the armed position is a position at which the track surface of a safing sector forms part of a bolt track of the firearm. In some embodiments, for example, the armed position is a position at which the track surface of a safing sector is aligned with a first side of a (helical) bolt track of a rotary firearm to within a +/−10% tolerance. In such embodiments the safe position is a position at which the track surface of the safing sector is more than 10% out of alignment with the first side of the (helical) bolt track of the rotary firearm.

As discussed below the firearm safing assemblies of the present disclosure include a safing sector with an inward facing surface, a track surface, and a receiver door track, wherein the safing sector is receivable within an opening in the receiver door track. In operation the inward facing surface and the track surface move substantially linearly with respect to a first axis extending through a receiver of a firearm when the safing sector is moved between a safe and an armed position. The firearm safing assemblies described herein may further include a lever and a safing cam. The lever is rotatable about a second axis that extends substantially perpendicular to the first axis. The safing cam is configured to convert rotational motion of the lever to substantially linear motion of the safing sector (relative to the first axis), causing the safing sector to move between the safe position and the armed position.

In embodiments the lever (and an optional handle attached thereto) may be in an elevated position when the safing sector is in the safe position, and in a lowered position when the safing sector is in the armed position. In the elevated position the lever may extend along a plane that extends substantially perpendicular to the first axis, whereas in the lowered position the lever may extend along a plane that extends substantially parallel to the first axis. Accordingly, an individual looking at the firearm may readily determine whether the firearm is in a safe or armed condition by the position of the lever. The firearm safing assembly may be further configured to be installed on a top or a bottom of the receiver, facilitating observation of its position from many viewing angles.

In embodiments the lever may be moved between the elevated and lowered position by a latch handle. The latch handle may include a latch member that is configured to engage and disengage with one or more latch stops that are included in a cam guide that is coupled to or integral with the receiver door track. The position of the latch member may be changed by moving the latch handle relative to the lever. Engagement and disengagement of the latch member with a latch stop may be accomplished by moving the latch handle with one or both hands, and in some embodiments the latch handle is configured for one hand operation. For example, to move the firearm safing assembly from the armed to the safe position, a user may exert a (pulling) force on the latch handle to disengage the latch member from a second (lower) latch stop. The user may then rotate the lever about a pin axis in a first direction with the handle. In response to rotation of the lever in the first direction, the safing cam may cause the safing sector to move substantially linearly away from a first axis extending through a receiver, thereby causing track surface of the safing sector to be moved out of alignment with a first side of a bolt track of the firearm. The latch member may then be engaged with a first (upper) latch stop to lock the firearm safing assembly in the safe position. To move the firearm safing assembly from the safe position to the armed position, a user may exert the same operations to disengage the latch member from the first latch stop and rotate the handle and lever about the pin axis in a second direction that is substantially opposite the first direction. Rotation of the handle and lever in the second direction may cause the safing sector to move substantially linearly towards the first axis, eventually causing the track surface to align with the first side of the bolt track. The latch member may then be engaged with the second latch stop to lock the firearm safing assembly in the armed position.

FIGS. 2A-2J depict various views of one example of a machine gun receiver 200 that include one example of a firearm safing assembly 201 consistent with the present disclosure. FIGS. 3A-3N depict various views of the firearm safing assembly 201 independent of machine gun receiver 200. While the firearm safing assembly 201 will be described in the context of machine gun receiver 200 for the sake of clarity and ease of understanding, the present disclosure encompasses firearm safing assemblies independent of any firearm. Moreover, while the present disclosure focuses on firearm safing assemblies that are adapted for use with rotary firearms (e.g., minigun such as the M-134), firearm safing assemblies consistent with the present disclosure may be configured for use with any suitable firearm.

Figure 3E:
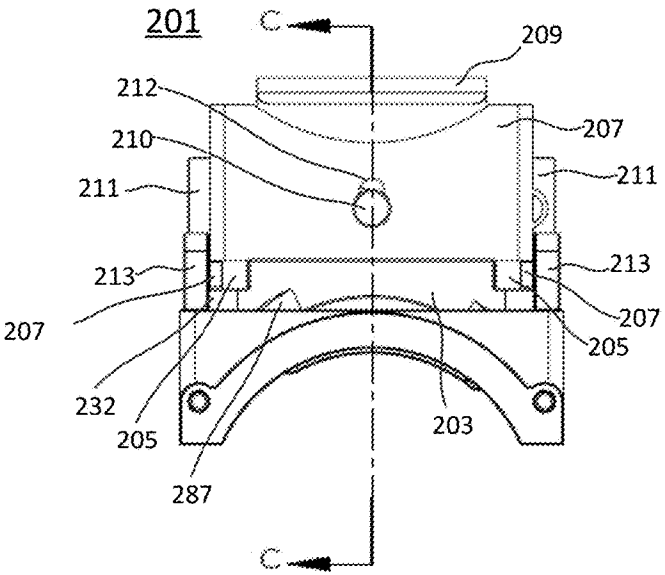
FIG. 3E is a front view of the example firearm safing assembly shown in FIGS. 3A-3D in a safe position.
Figure 3D:
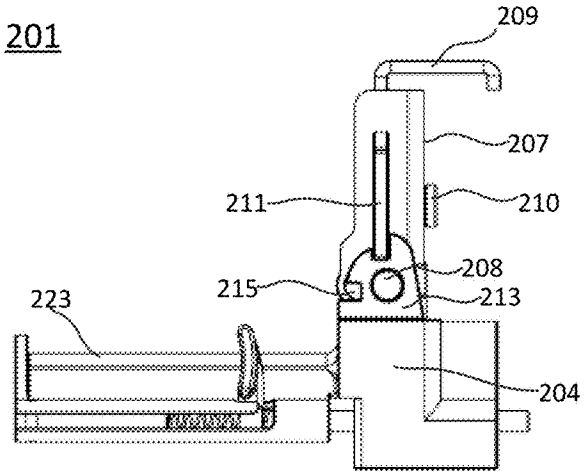
FIG. 3D is a right-side view of the example firearm safing assembly shown in FIGS. 3A-3C in a safe position.
Figure 3F:
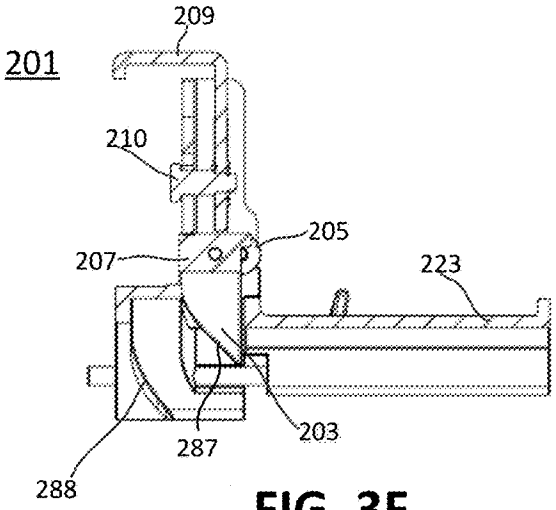
FIG. 3F is a cross sectional view along section C-C of the example firearm safing assembly shown in FIG. 3E in a safe position.
Figure 3H:
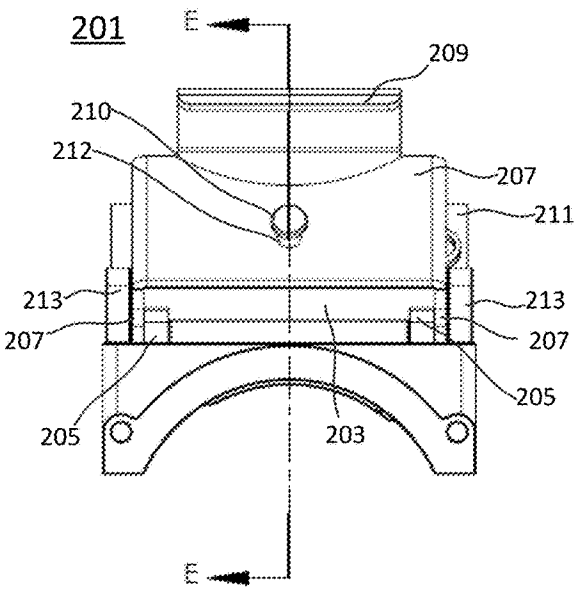
FIG. 3H is a front view of the example firearm safing assembly shown in FIGS. 3A-3G in an intermediate position.
Figure 3G:
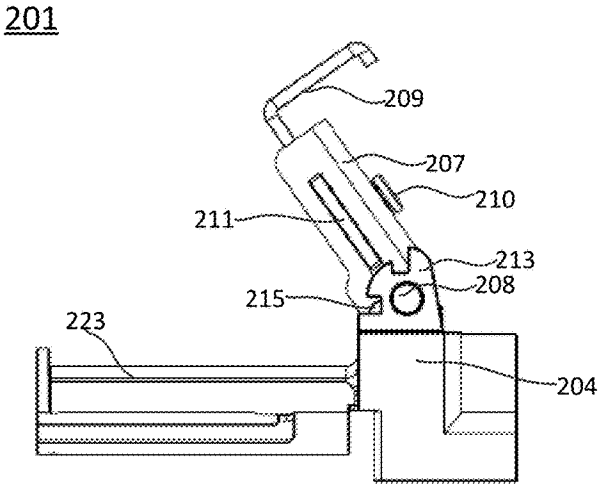
FIG. 3G is a right-side view of the example firearm safing assembly shown in FIGS. 3A-3F in an intermediate position.
Figure 3I:
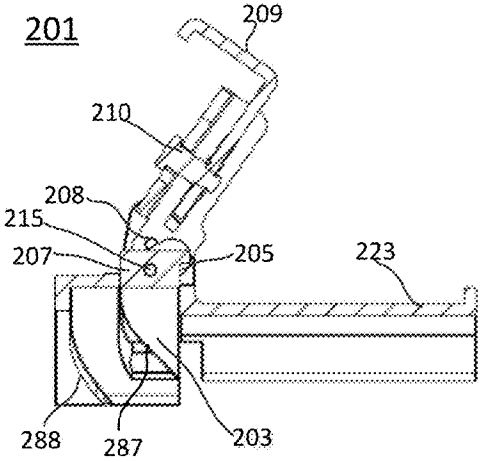
FIG. 3I is a cross sectional view along section E-E of the example firearm safing assembly shown in FIG. 3H in an intermediate position.
Figure 3K:
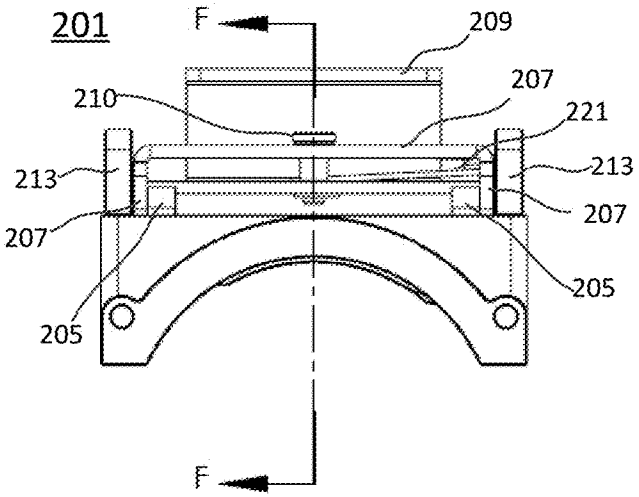
FIG. 3K is a front view of the example firearm safing assembly shown in FIGS. 3A-3I in an armed position.
Figure 3J:
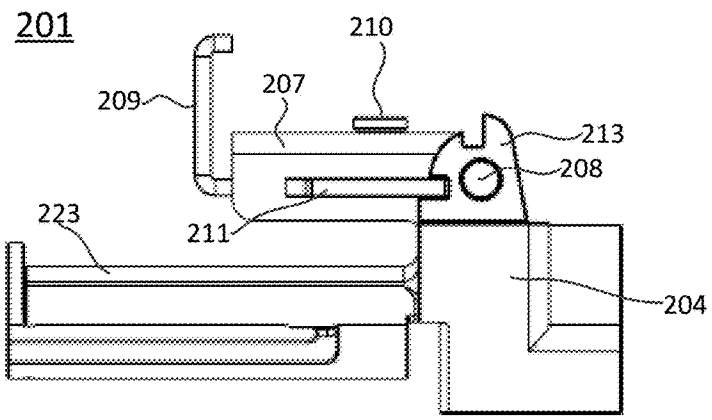
FIG. 3J is a right-side view of the example firearm safing assembly shown in FIGS. 3A-3I in an armed position.
Figure 3L:
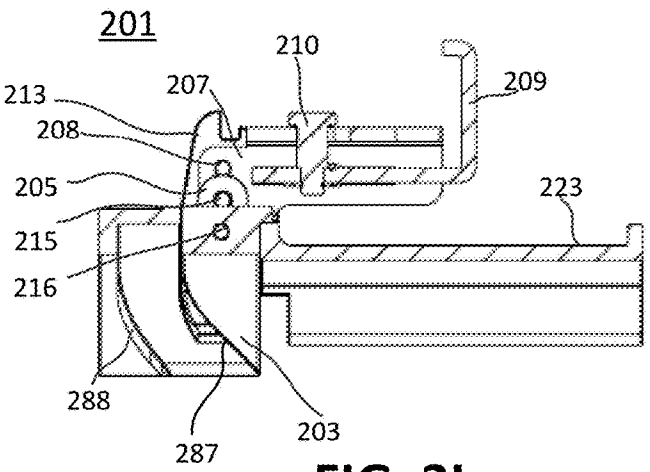
FIG. 3L is a cross sectional view along section F-F of the example firearm safing assembly shown in FIG. 3K in an armed position.
Figure 3M:
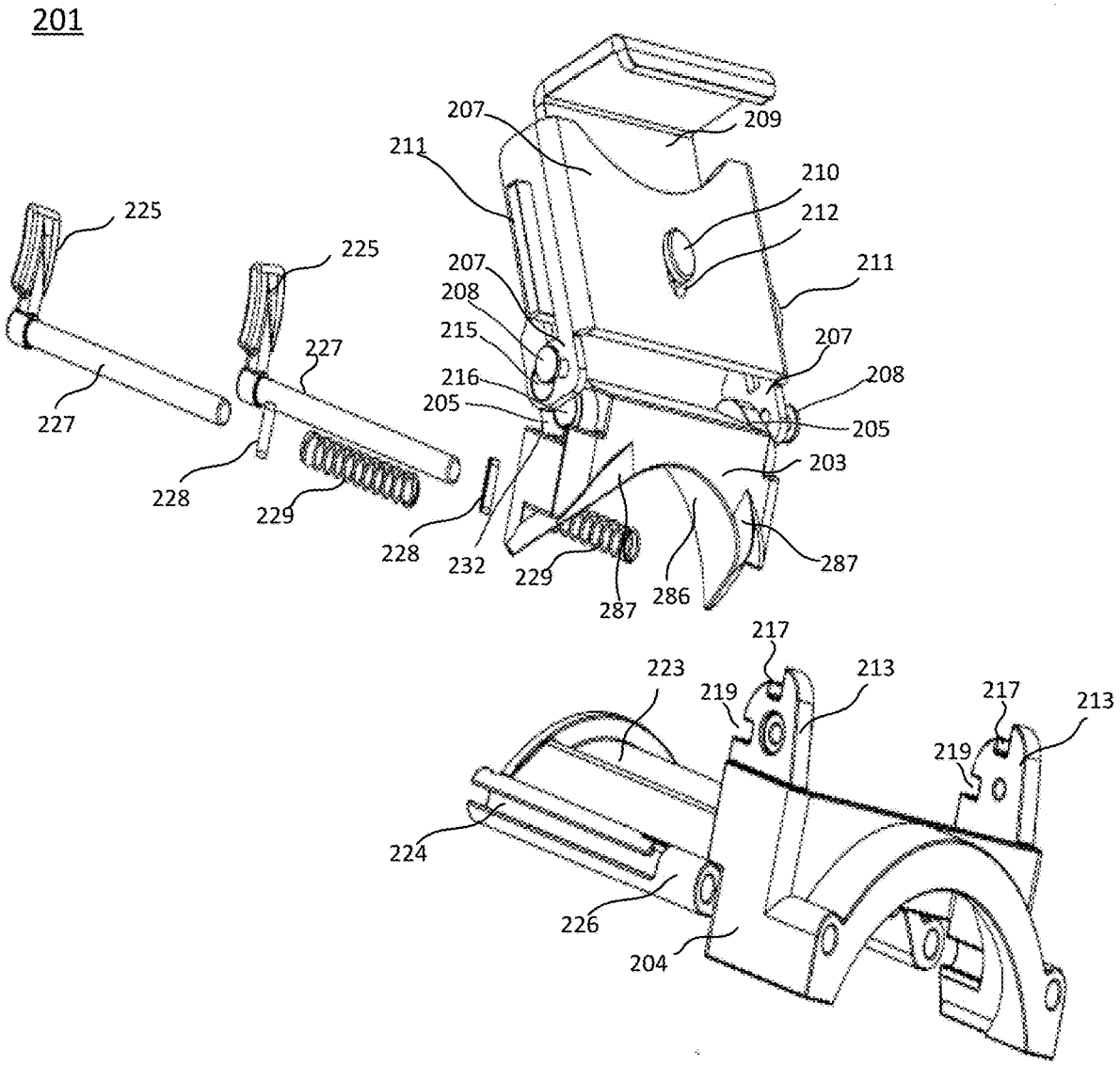
FIG. 3M is a first partial exploded view of the example firearm safing assembly shown in FIGS. 3A-3L.

As best shown in FIGS. 3L, 3M and 3N, firearm safing assembly 201 includes safing sector 203 and a receiver door track 204. The safing sector 203 is receivable within an opening in receiver door track 204 and is movable between a safe position, an intermediate position, and an armed position. That concept is best shown in FIGS. 3F, 3I, and 3L, which depict firearm safing assembly 201 (and, more particularly, safing sector 203) in a safe (FIG. 3F), intermediate (FIG. 3I), and armed (FIG. 3L) position.

Returning to FIGS. 3L, 3M and 3N, firearm safing assembly 201 further includes safing cams 205 that are coupled to a lever 207. In this embodiment lever 207 is coupled to cam guide 213 with a lever pin 208. In turn, each cam guide 213 is coupled to one of safing cams 205 via a first cam link pin 215, and each safing cam 205 is coupled to safing sector 201 via a second cam link pin 216. Although pins 208, 215, 216 are shown in the illustrated embodiments, any suitable coupling mechanism may be used. In general, safing cams 205 are configured to convert rotational motion of lever 209 to linear or substantially linear motion of safing sector 203. In embodiments, such conversion may be caused by the interaction of safing cams 205 with corresponding camming surfaces 232 on safing sector 203, as shown in FIGS. 3D, 3M, and 3N. In embodiments the camming surfaces 232 may be in the form of one or more shoulders that are laterally offset from the inward facing surface 286 of safing sector 203.

A latch handle 209 is coupled to the lever 207. In the illustrated embodiment latch handle 209 is coupled to the lever 207 by a handle pin 210 that extends at least partially through a first handle slot 212 (within lever 207) and a second handle slot 212' (within handle 209), as best shown in FIGS. 3F and 3N. While handle pin 210 is used in this embodiment, any suitable coupling mechanism may be used.

Latch handle 209 further includes latch members 211, as best shown in FIG. 3N. In the illustrated embodiment latch members 211 are part of (i.e., integral with) handle 209, but separate latch members 211 that are coupled to handle 209 in any suitable fashion may also be used. In any case latch members 211 may be configured to extend through a corresponding one of latch member slots 214 that are integral with or coupled to lever 207, as best shown in FIG. 3M. Latch members 211 may be further configured to interact with cam guides 213, which are integral with or coupled to receiver door track 204 and are coupled to lever 207 and safing sector 203 in any suitable manner. As discussed above, each cam guide 213 is coupled to lever 207 by lever pin 208. Each cam guide 213 is also coupled to a safing cam 205 via a first cam link pin 215. And each safing cam 205 is also coupled to safing sector 201 via a second cam link pin 216.

Latch members 211 may interact with a corresponding one of cam guides 213 in any suitable manner. In embodiments latch members 211 are configured to engage within one or more latch stops of cam guides 213. That concept is best shown in FIGS. 3A-3C and 3M, which depict cam guides 213 as including a first latch stop 217 and a second latch stop 219, wherein the first and second latch stops 217, 219 are configured to receive a respective one of latch members 211. For example, and as best shown FIG. 3A, latch members 211 may engage with (e.g., be at least partially seated in) first latch stop 217 when firearm safing assembly 201 is in a safe position. To transition firearm safing assembly 201 to an armed position, force may be exerted on handle 209 to retract latch members 211 from first latch stop 217. When latch members 211 are sufficiently retracted, force may be exerted on handle 209, causing handle 209, latch member 211, and lever 207 to rotate in a first direction about an axis (i.e., a pin axis) extending through lever pin 208. During that rotation firearm safing assembly 201 may pass through an intermediate position (best shown in FIG. 3B), wherein latch members 211 are disposed between first latch stop 217 and second latch stop 219. Force may continue to be applied to handle 209 to cause handle 209, latch members 211, and lever 207 to rotate further in the first direction about the pin axis and advance firearm safing assembly to the armed position. This is best shown in FIG. 3C, wherein latch members 211 are shown engaged with second latch stops 219.

In embodiments and as best shown in FIG. 3N, the firearm safing assembly 201 may further include a handle spring 221. In general the handle spring 221 is configured to bias latch handle 209 (and, more particularly, latch members 211) towards the cam guides 213 or, more particularly, towards the axis extending through lever pin 208. Consequently, handle spring 221 facilitates engagement of latch members 211 with first and second latch stops 217, 219 by spring biasing latch members 211 towards cam guides 213. To transition firearm safing assembly 201 from the safe to the armed position or vice versa, a (pulling or pushing) force sufficient to overcome the spring force applied by handle spring 221 may be applied to latch handle 209 to retract latch members 211 from first or second latch stops 217, 219. The shape of latch handle 209 may be configured to facilitate application of such force with one or two hands. For example, and as shown in various FIGS. latch handle 209 may have substantially L or U shaped cross-sectional profile, enabling it to be easily gripped and manipulated with one hand.

The receiver door track 204 may further include a cover 223, as best shown in FIGS. 3M and 3N. In the illustrated embodiment the cover 223 is integral with receiver door track 204, but such a configuration is not required and in embodiments cover 223 may be a separate component that is coupled to receiver door track in any suitable manner. Without limitation, cover 223 may be configured to cover one or more components of a machine gun. For example, when firearm safing assembly 201 is coupled to a receiver 201 of a rotary firearm such as a minigun (e.g., an M-134), cover 223 may be disposed over a rotor and bolt assembly of the machine gun.

Among other things, receiver door track 204 is configured to couple firearm safing assembly 201 to a machine gun receiver 200. Accordingly, receiver door track 204 (or, more particularly, cover 223) may include one or more cover retention slots 224, as best shown in FIGS. 3M and 3N. Each cover retention slot 224 may include a cover retention keeper 227, and may be configured to receive a retention tab 225, a retention pin 226, an optional retention stop 228, and a retention spring 229. With reference to FIG. 2B, firearm safing assembly 201 (or more particularly, receiver door track 204) may be configured to seat on an upper portion of machine gun receiver 200. When receiver door track 204 is properly seated, cover retention slot 224 and an opening within cover retention keeper 226 align or substantially align with an opening within safing keeper 284 on machine gun receiver 200. To couple receiver door track 204 to machine gun receiver 200, retention spring 229 is inserted into retention slot 224 and slid proximally down retention slot 224 towards retention keeper 226. Retention pin 227 may then be inserted into cover retention slot 224 and slid proximally therein through retention spring 229 and retention keeper 226, and into safing keeper 284. Cover retention tab 225 may be integral with or coupled to retention pin 227. In any case, cover retention tab 225 may be slid (with cover retention pin 227) along an opening in cover retention slot 224 as retention pin 227 is moved proximally towards safing keeper 284.

When retention pin 227 is disposed through cover retention keeper 226 and is sufficiently within safing keeper 284, retention tab 225 may be aligned with a notch in cover retention slot 224. At that point retention tab 225 may be rotated into the notch in cover retention slot 224 and released. Upon release, retention spring 229 may spring bias retention tab 225 against the notch in cover retention slot 224, urging retention pin 227 in place and joining receiver door track 204 with machine gun receiver 200. To prevent unintentional withdrawal of retention pin 227 and retention spring 229 from retention slot 224, optional retention stop 228 may be inserted through one or more openings at a distal end of retention slot 224, e.g., as shown in FIG. 2B.

As best shown in FIGS. 2I, 2J, 3E, 3F, 3I, and 3L, and 3M when firearm safing assembly 201 is in an armed position, the inward facing surface 286 of movable safing sector 203 is disposed towards a first axis B-B extending through an opening of the machine gun receiver, and a track surface 287 of movable safing sector 203 is aligned or substantially aligned with a first side 288 of (helical) bolt track 282 of machine gun receiver 200, wherein the bolt track 282 extends around the first axis (B-B). In that position the track surface 287 forms part of the (helical) bolt track 282. In contrast when firearm safing assembly 201 is in a safe position, inward facing surface 286 is disposed away from the first axis B-B and track surface 287 is out of alignment with the first side 288 of (helical) bolt track 282, such that track surface 287 does not form a part of bolt track 282.

When firearm safing assembly 201 is moved from the armed position to a safe position, the inward facing surface 286 and track surface 287 move substantially linearly in a first direction that is perpendicular or substantially perpendicular to the first axis B-B. Conversely when firearm safing assembly 201 is moved from the safe position to the armed position, the inward facing surface 286 and track surface 287 move substantially linearly in a second direction that is opposite or substantially opposite the first direction. The movement of the inward facing surface 286 and track surface 287 is best shown in FIGS. 2I, 2J, 3A-3C and FIGS. 3E, 3F, 3I, and 3L, which show the relative position of the receiver door track 203, the inward facing surface 286, and the track surface 287 when the firearm safing assembly 201 is in the safe position (FIGS. 2I, 3A, 3F), an intermediate position (FIGS. 3B, 3I), and the armed position (FIGS. 2J, 3C, 3L). As best shown by FIGS. 3F, 3I, and 3L, during a transition from the safe position (FIG. 3F) to the armed position (FIG. 3L), inward facing surface 286 and track surface 287 move substantially linearly in a direction towards a first axis B-B, thereby aligning or substantially aligning the track surface 287 with the first side of bolt track 282 (or, more specifically, with the first side 288 of bolt track 282). During a transition from the armed position (FIG. 3L) to the safe position (FIG. 3F), inward facing surface 286 and track surface 287 move substantially linearly in an opposite or substantially opposite direction until track surface 287 is out of alignment with the first side 288 of bolt track 282.

Figure 2A:
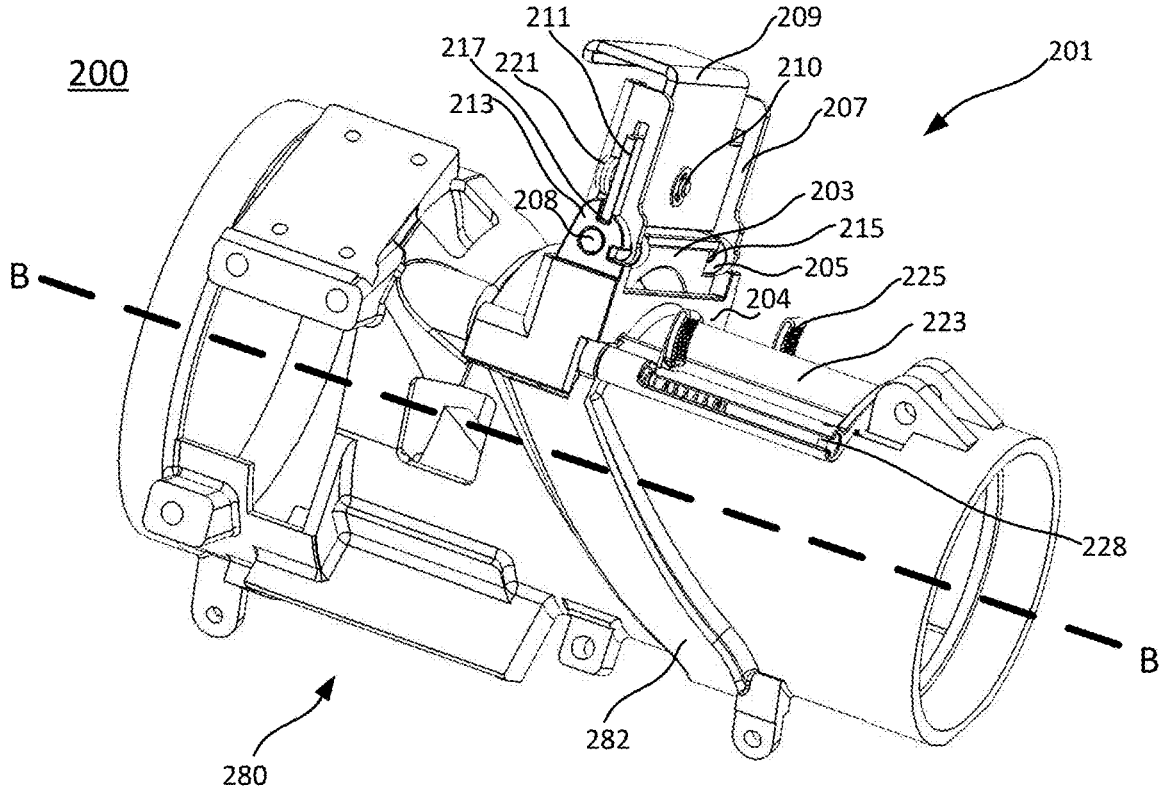
FIG. 2A is a left perspective view of one example of a rotatable firearm including a firearm safing assembly consistent with the present disclosure in a safe position.
Figure 2B:
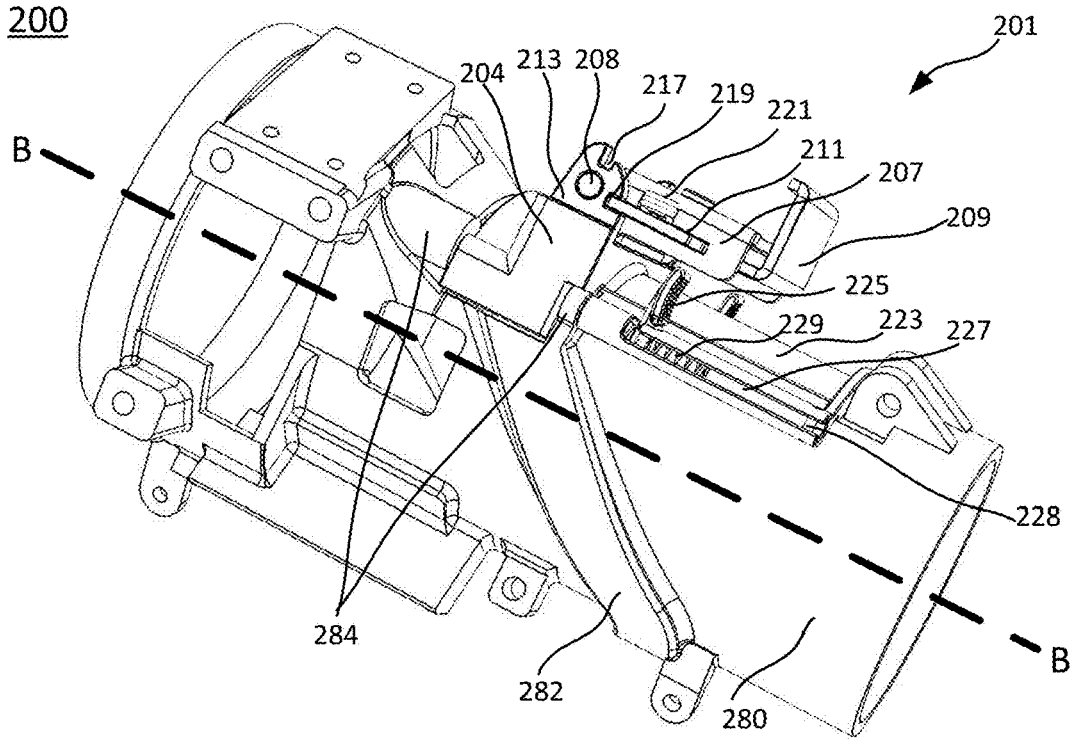
FIG. 2B is a left perspective view of the example rotatable firearm shown in FIG. 2A, with the firearm safing assembly in an armed position
Figure 2C:
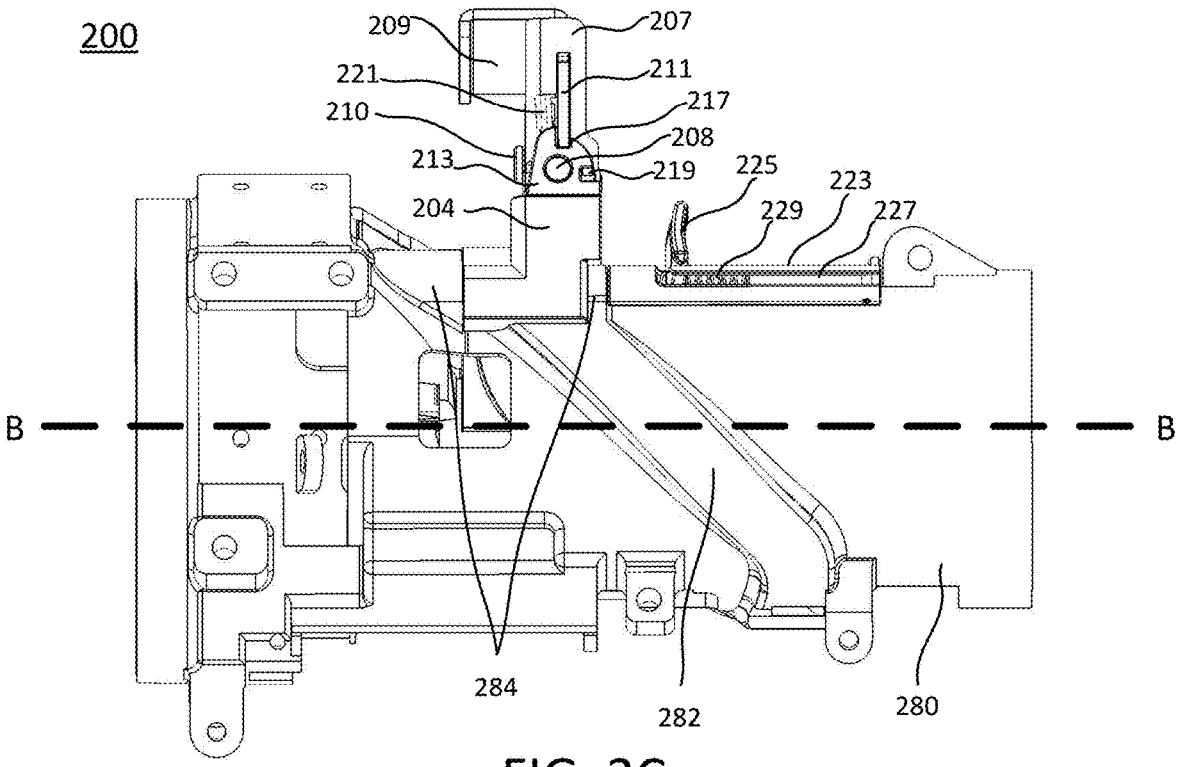
FIG. 2C is a left side view of the example rotatable firearm shown in FIGS. 2A and 2B, with the firearm safing assembly in the safe position.
Figure 2D:
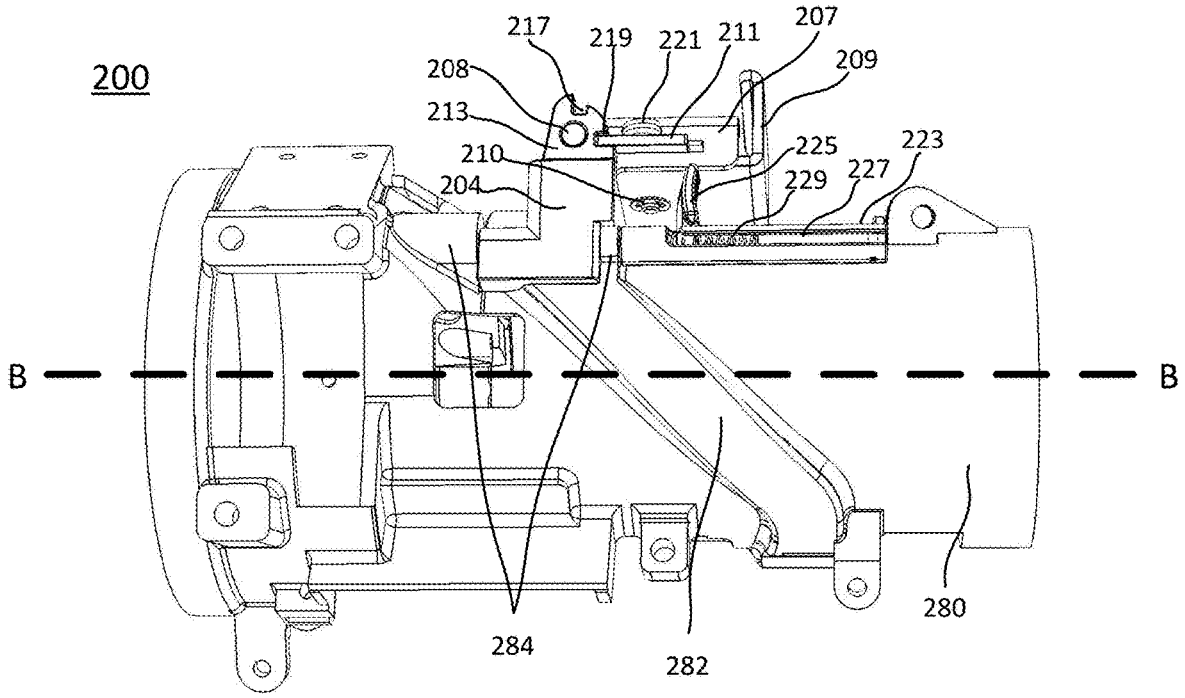
FIG. 2D is a left side view of the example rotatable firearm shown in FIGS. 2A-2C, with the firearm safing assembly in the armed position.
Figure 2E:
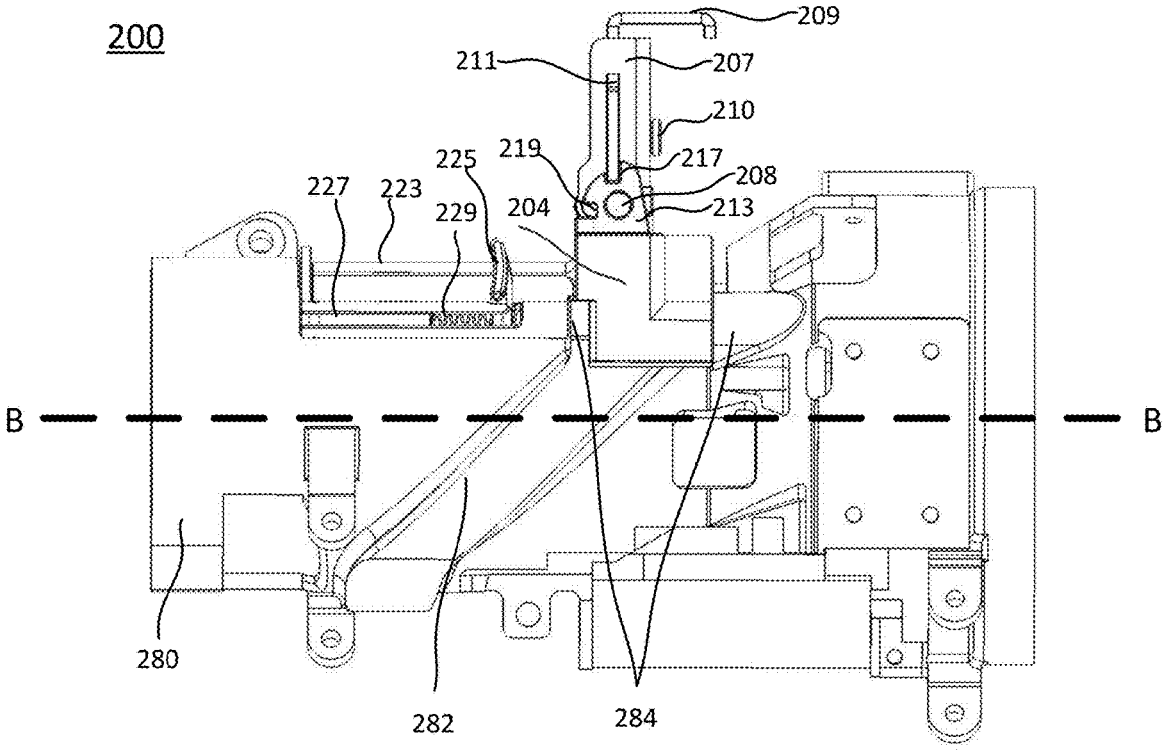
FIG. 2E is a right-side view of the example rotatable firearm shown in FIGS. 2A-2D, with the firearm safing assembly in the safe position.
Figure 2F:
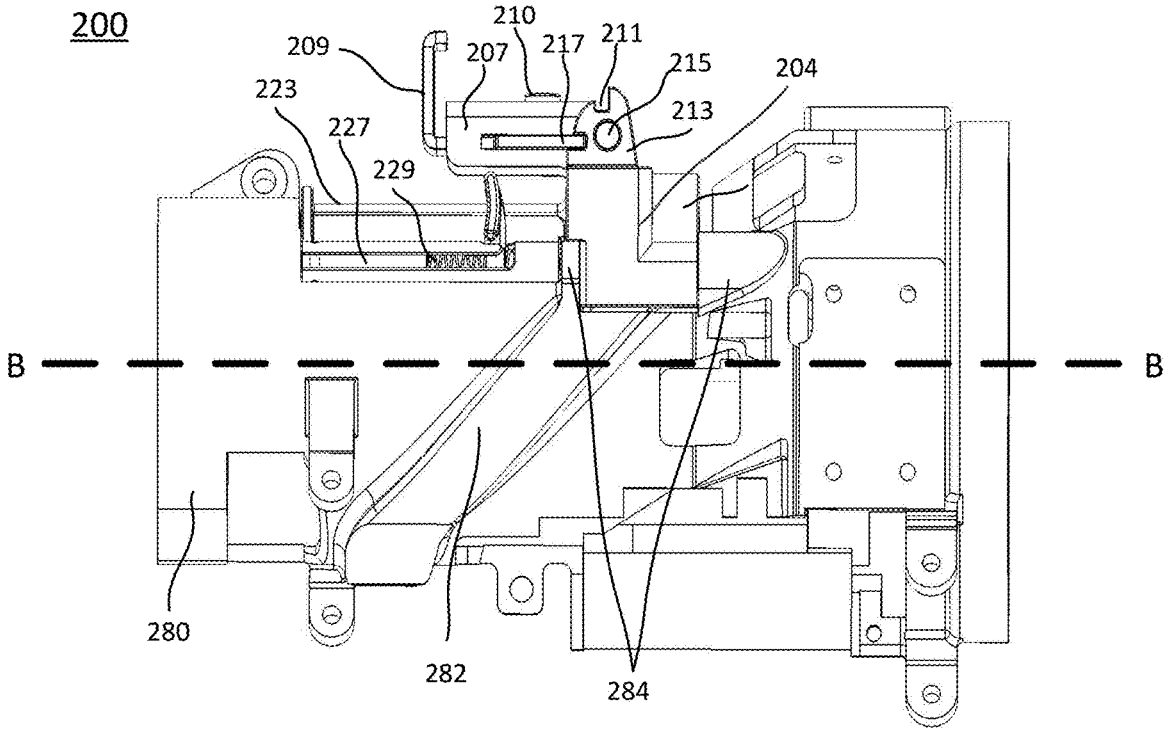
FIG. 2F is a right-side view of the example rotatable firearm shown in FIGS. 2A-2E, with the firearm safing assembly in the armed position.
Figure 2H:
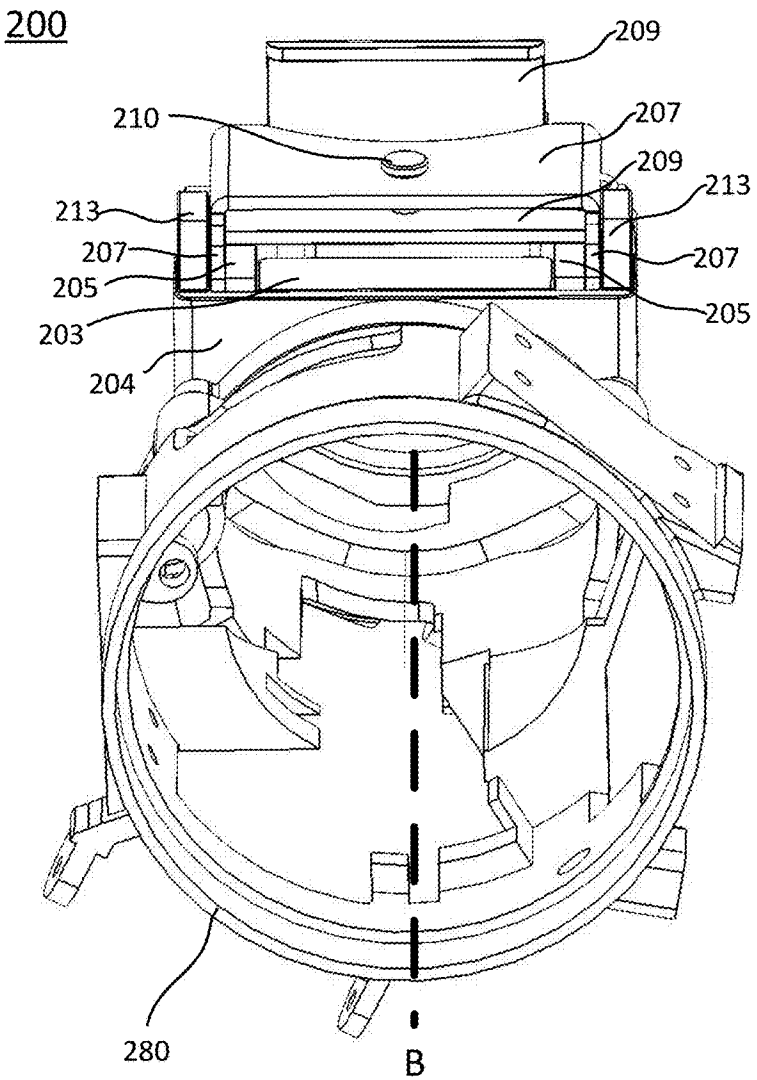
FIG. 2H is a front view of the example rotatable firearm shown in FIGS. 2A-2G, with the firearm safing assembly in the armed position.
Figure 2G:
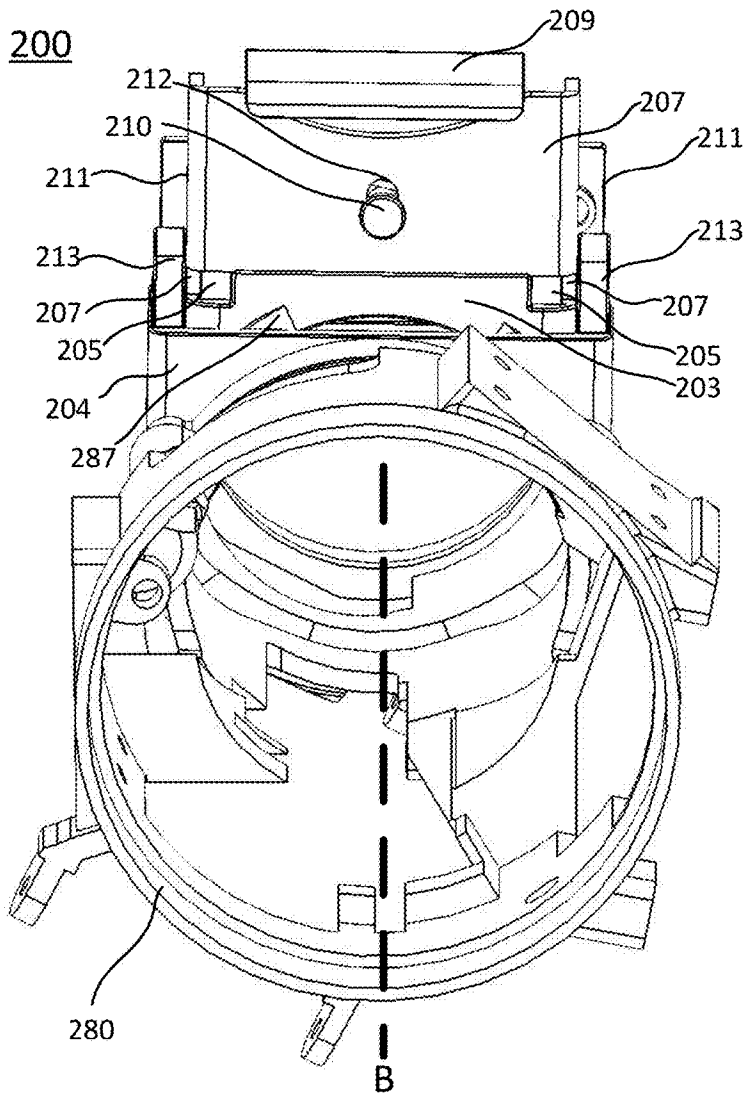
FIG. 2G is a front view of the example rotatable firearm shown in FIGS. 2A-2F, with the firearm safing assembly in the safe position.
Figure 2J:
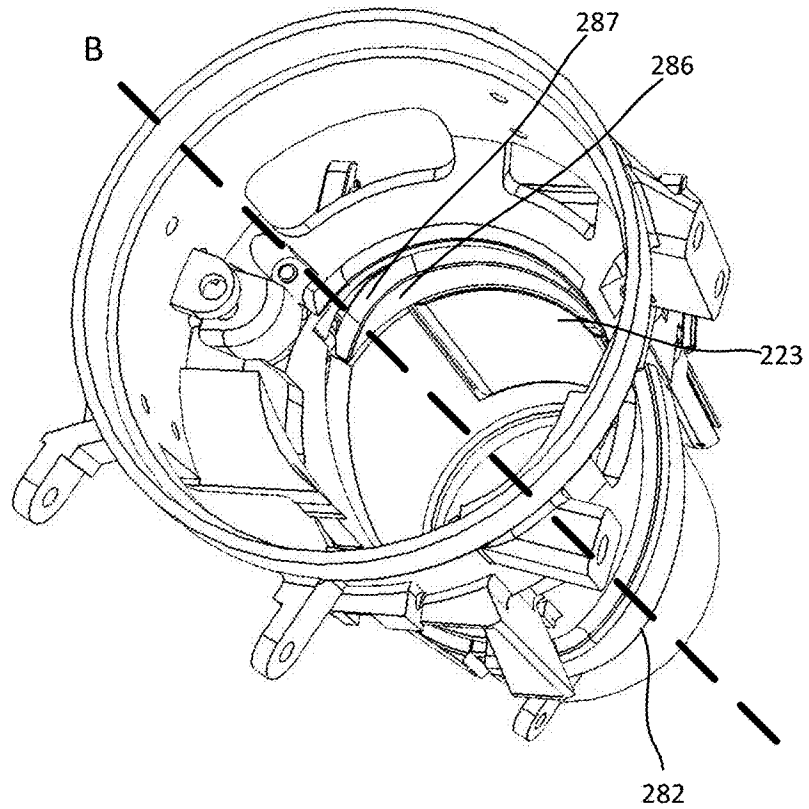
FIG. 2J is a front perspective view of the example rotatable firearm shown in FIGS. 2A-2I, with the firearm safing assembly in the armed position.
Figure 2I:
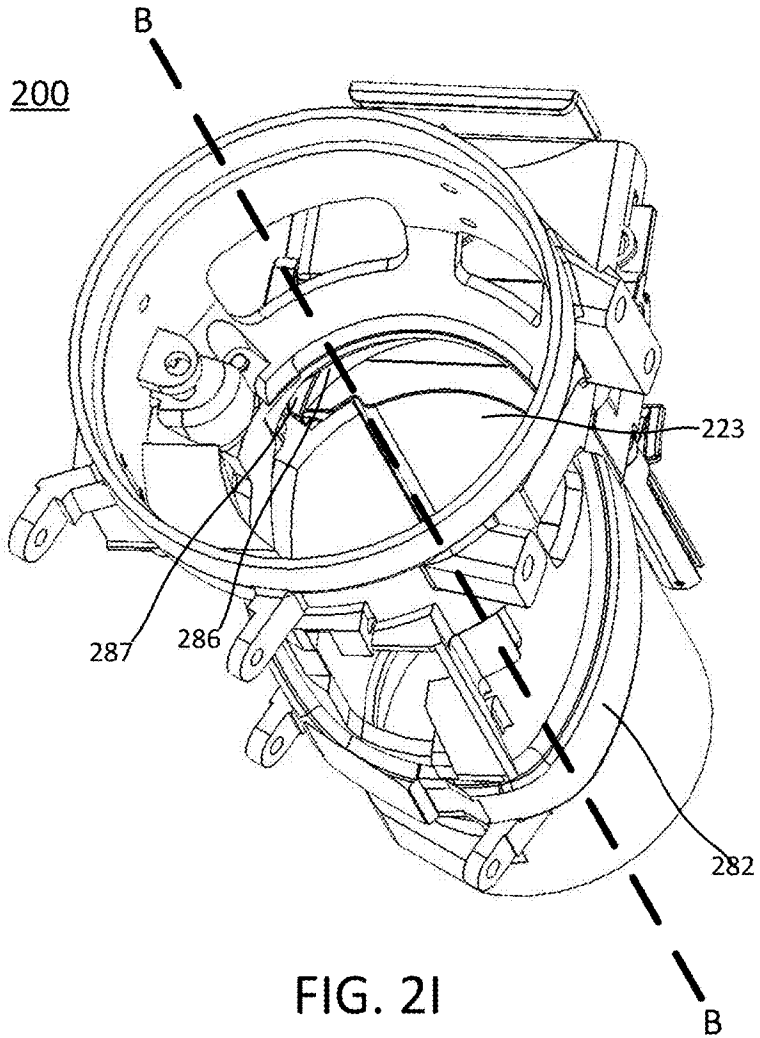
FIG. 2I is a front perspective view of the example rotatable firearm shown in FIGS. 2A-2H, with the firearm safing assembly in the safe position.
Figure 3N:
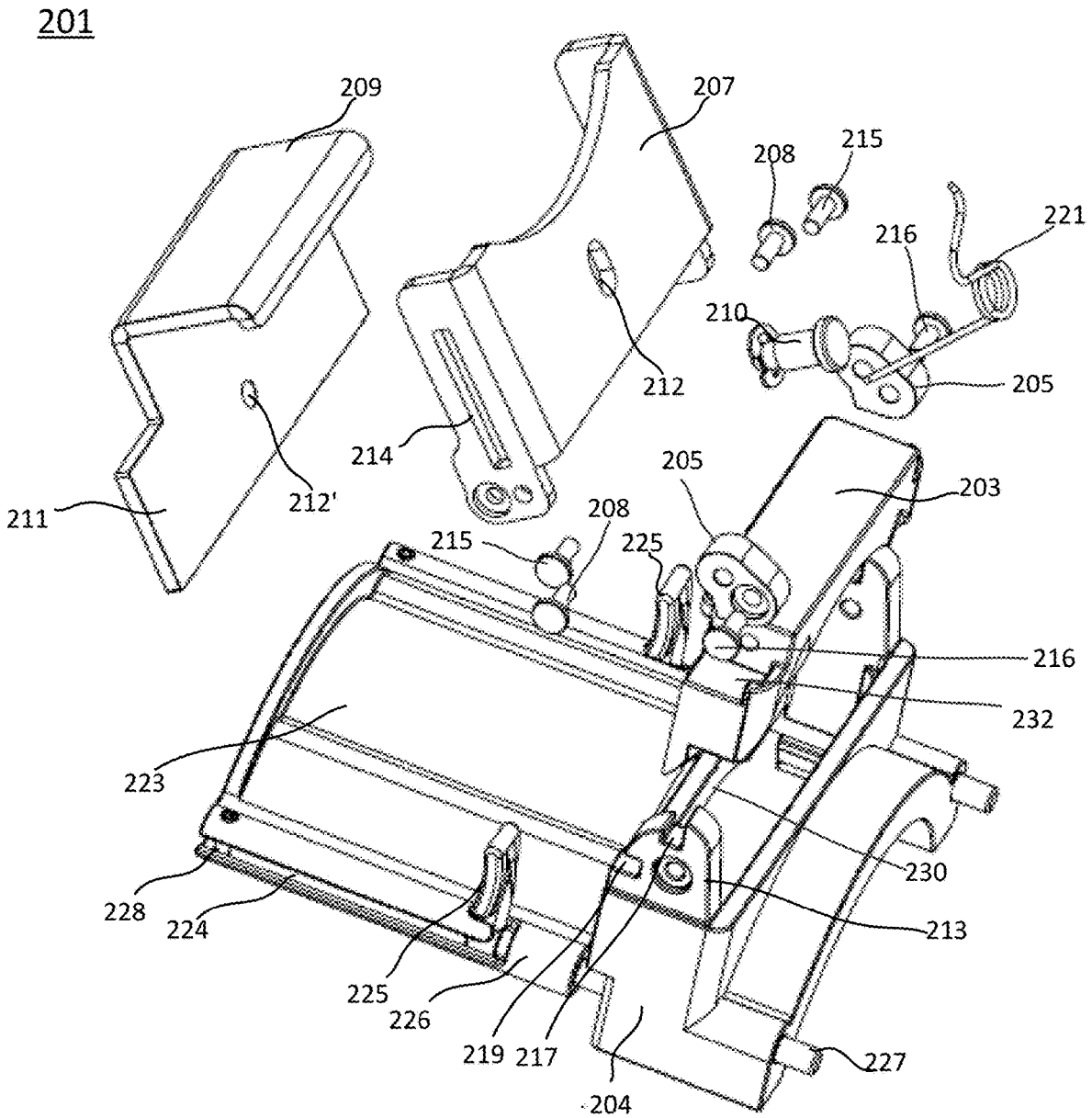
FIG. 3N is a second partial exploded view of the example firearm safing assembly shown in FIGS. 3A-3M.
Figure 4B:
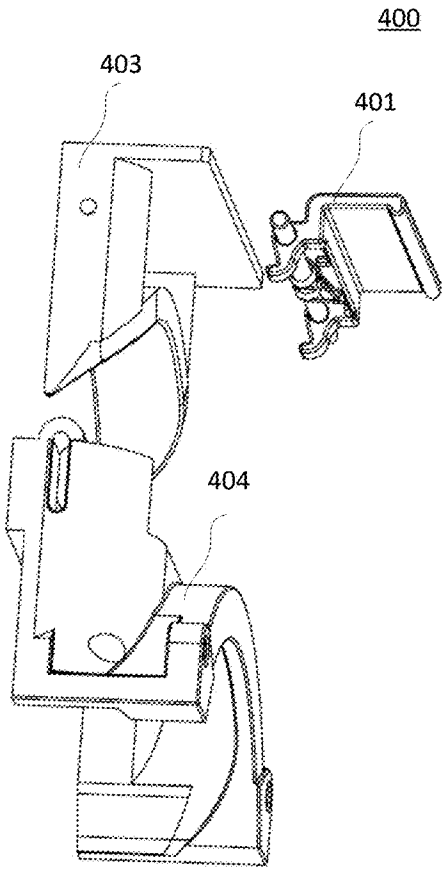
FIG. 4B is a left exploded view of the firearm safing assembly shown in FIG. 4A.
Figure 4C:
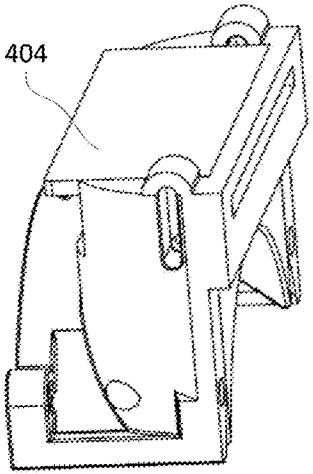
FIG. 4C is a top right perspective view of a receiver door track used in the example firearm safing assembly shown in FIGS. 4A and 4B.
Figure 4D:
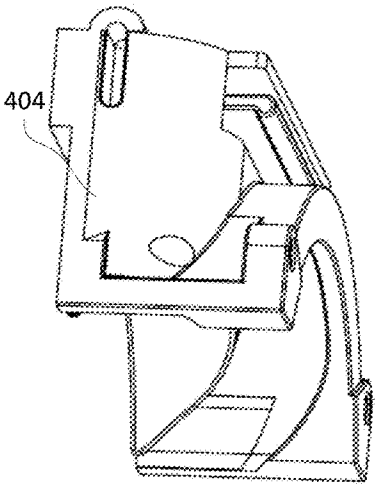
FIG. 4D is a bottom left perspective view of a receiver door track used in the example firearm safing assembly shown in FIGS. 4A and 4B.
Figure 4A:
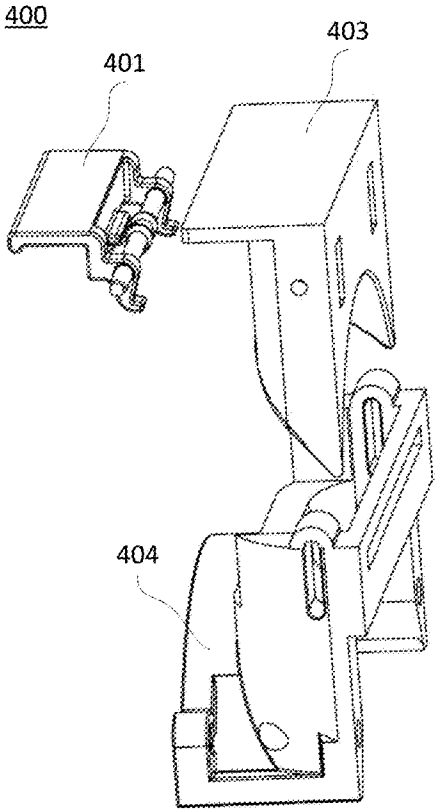
FIG. 4A is a right exploded view of another example of a firearm safing assembly consistent with the present disclosure.
Figure 5B:
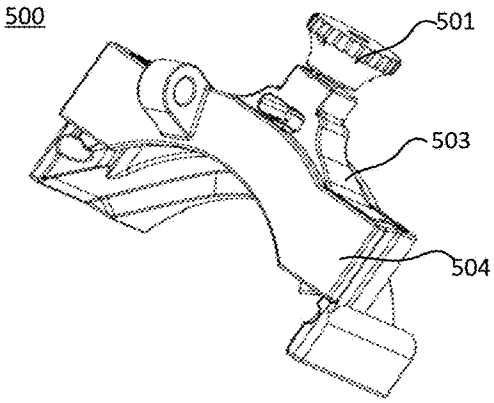
FIG. 5B is a bottom right perspective view of the example firearm safing assembly shown in FIG. 5A.
Figure 5D:
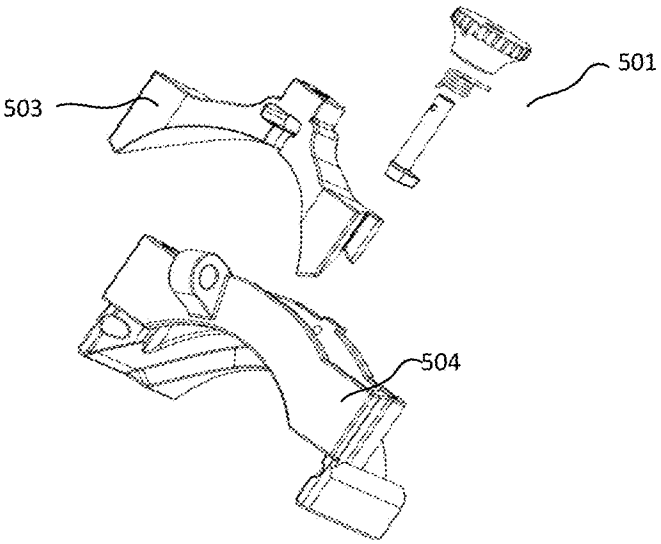
FIG. 5D is a second exploded view of the example firearm safing assembly shown in FIGS. 5A and 5B.
Figure 5A:
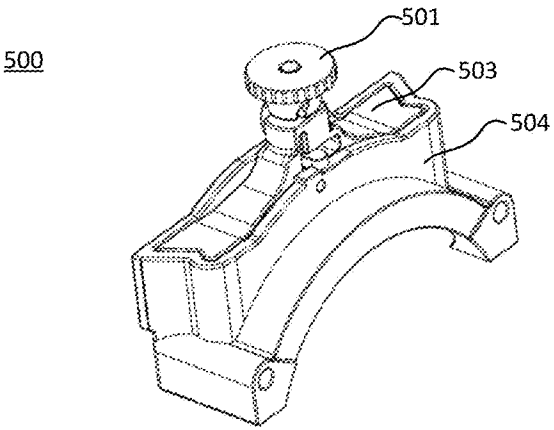
FIG. 5A is a top right perspective view of another example of a firearm safing assembly consistent with the present disclosure.
Figure 5C:
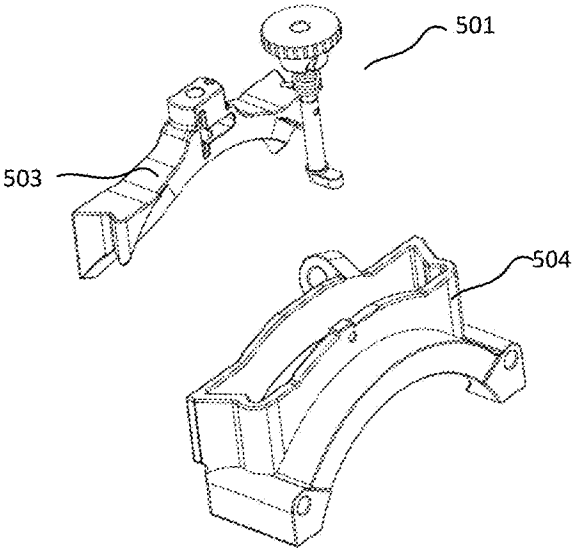
FIG. 5C is a first exploded view of the example firearm safing assembly shown in FIGS. 5A and 5B.
Figure 6A:
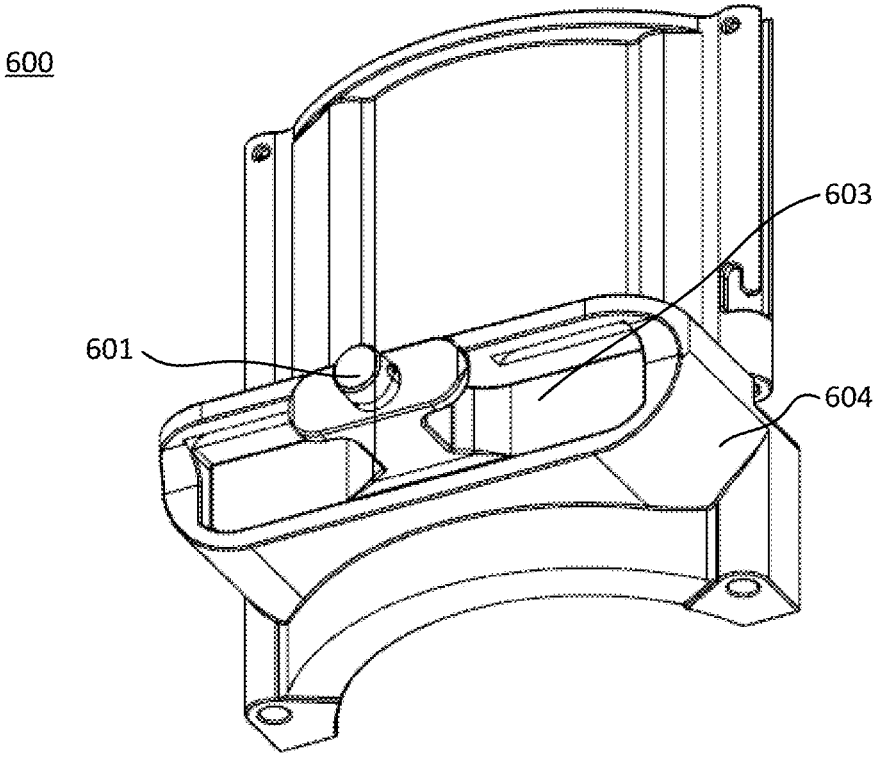
FIG. 6A is a top perspective view of another example firearm safing assembly consistent with the present disclosure.
Figure 6B:
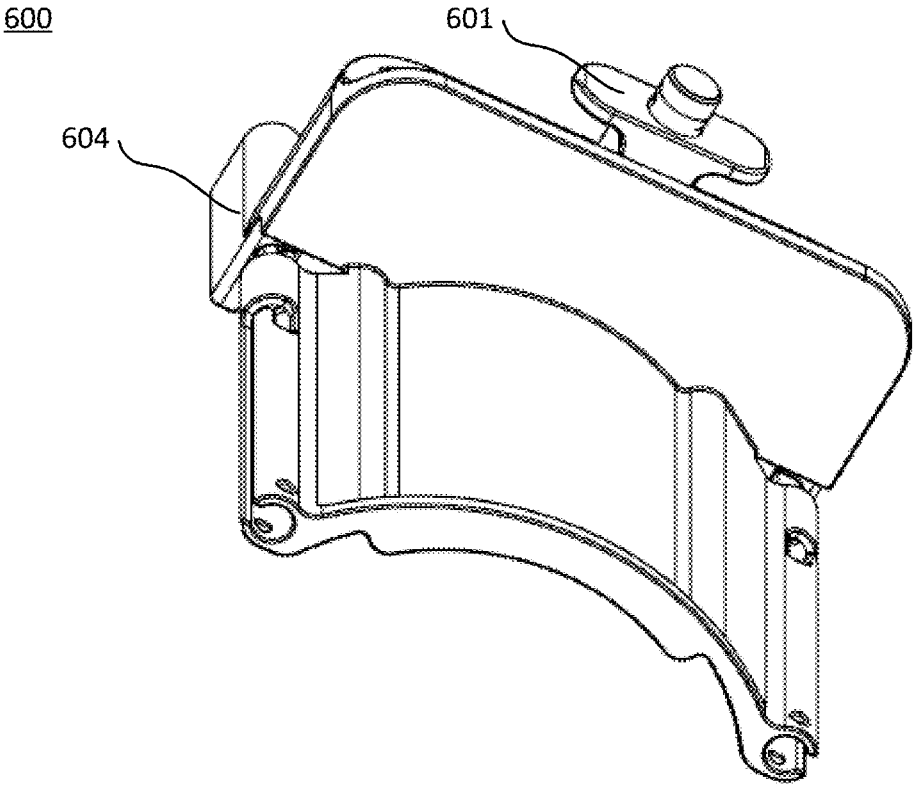
FIG. 6B is a rear perspective view of the example firearm safing assembly shown in FIG. 6A.
Figure 6C:
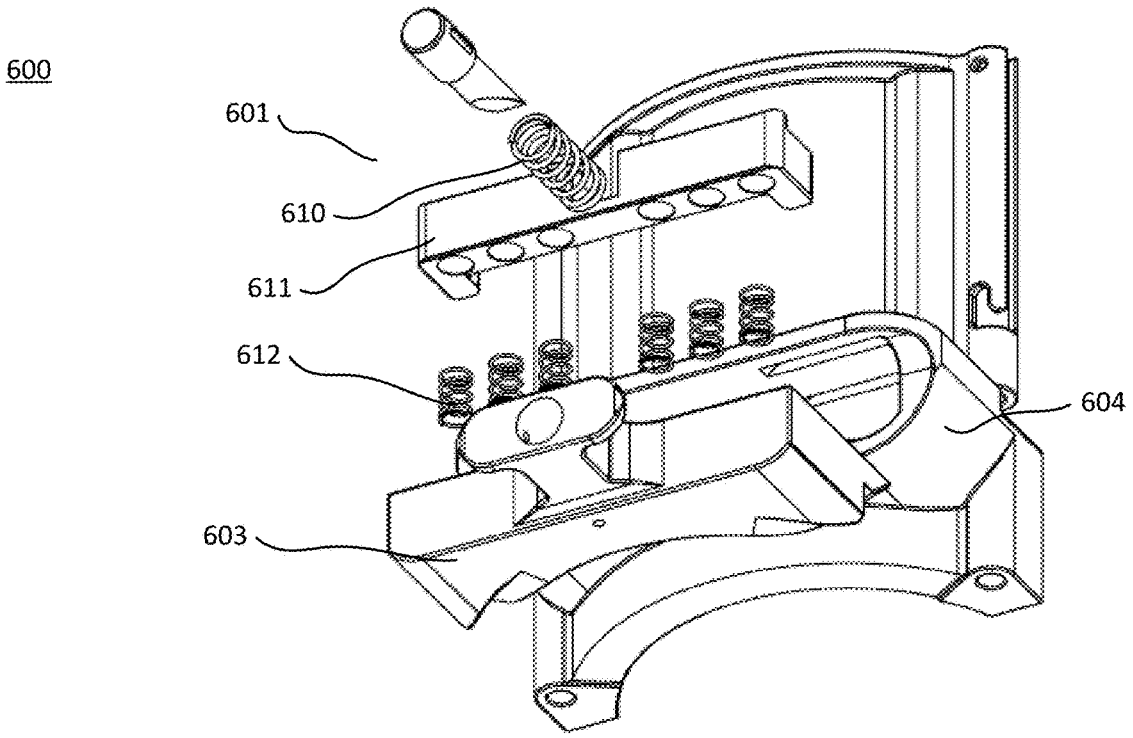
FIG. 6C is a first exploded view of the example firearm safing assembly shown in FIGS. 6A and 6B.
Figure 6D:
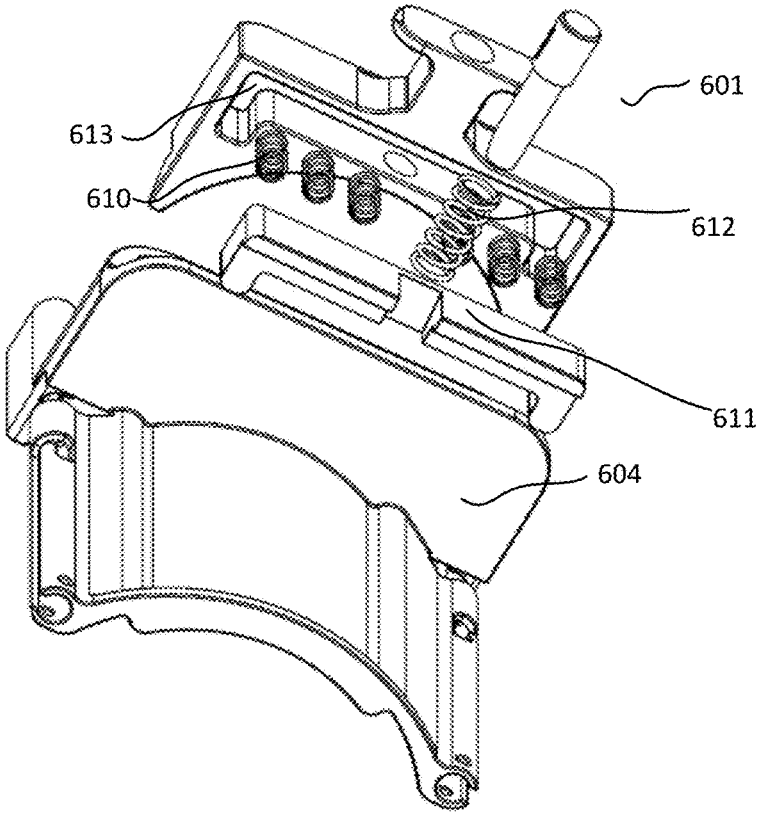
FIG. 6D is a second exploded view of the example firearm safing assembly shown in FIGS. 6A and 6B.

For clarity the present disclosure will now describe the movement of the firearm safing assembly 201 from a safe position to an armed position with reference to FIGS. 2A, 2B, 2G, 2J, 3A, 3C, 3F, 3G, and 3L. As shown in FIGS. 2A and 3F, in the safe position lever 207, latch handle 209, and latch members 211 are in an upright orientation, with latch members 211 engaged within first latch stops 217 of cam guides 213. In that position, safing sector 203 is displaced upwards relative to a first axis B-B extending through an opening of machine gun receiver 200. Consequently, track surface 287 of the safing sector 203 is out of alignment with the first side 288 of bolt track 282, as shown in FIG. 2G. As such, track surface 287 does not form part of bolt track 282 when firearm safing assembly 201 is in the safe position.

To transition firearm safing assembly 201 from the safe position shown in FIGS. 2A, 2G, 3A, and 3F to the armed position shown in FIGS. 2B, 2J, 3C, and 3L, force sufficient to overcome the biasing force imparted by handle spring 221 may be exerted on latch handle 209 in a direction substantially perpendicular to axis B-B. Such force may cause latch handle 209 to move relative to lever 207 and disengage latch members 211 from first latch stops 217. Movement of latch handle 209 relative to lever 207 may be facilitated by the movement of handle pin 210 within handle pin slot 212 in lever 207. Such movement is permitted because handle pin slot 212 in lever 207 is larger than handle pin slot 212' in latch handle 209.

Lever 207, latch handle 209, and latch members 211 may then be rotated towards a proximal end of receiver 200 and about a (pin) axis extending through lever pin 208. Such rotation causes safing cams 205 to rotate and interact with camming surfaces 232 to convert rotational motion of the lever 207 to linear or substantially linear motion of safing sector 203 (via pins 215, 216). More specifically, during such rotation, rotation and interaction of safing cams 205 with camming surfaces 232 causes safing sector 203 to move linearly or substantially linearly towards axis B-B. That motion is best shown by comparison of the position of safing sector 203 in FIG. 3F, with the position of safing sector 203 in FIGS. 3G and 3L.

As lever 207, latch handle 209, and latch members 211 are rotated toward the proximal end of receiver 200, firearm safing assembly 201 passes through an intermediate position best shown in FIGS. 3G to 3I. In that position, latch members 311 are generally disposed between first latch stop 317 and second latch stop 319. Further rotation of lever 207, latch handle 209, and latch members 211 moves safing sector 203 towards axis B-B, until latch members 211 are aligned with second latch stops 219. At that point the track surface 287 of safing sector 203 is aligned with a first side of bolt track 282, as shown in FIGS. 2J and 3L. Consequently, firearm safing assembly 201 is in the armed position, with track surface 287 forming part of bolt track 282. Latch handle 209 may be released. Upon release of latch handle 209, force imparted by handle spring 221 will urge latch members 211 into second latch stops 219, thereby securing firearm safing assembly 201 in the armed position. The alignment of pins 208, 215, 216 and safing cam 205 creates a toggle clamp structure that can robustly resist forces (e.g., during operation of a firearm) that may urge safing sector 203 out of position. For example, the arrangement of pins 208, 215, 216 and safing cams 205 causes applied forces to largely transfer to pins 216 and cam guide 213.

To transition firearm safing assembly from the armed position to the safe position, substantially the opposite operations may be performed. Specifically, force may be applied to latch handle 209 (e.g., in a direction substantially parallel to axis B-B), to disengage latch members from second latch stops 219. Lever 207, latch handle 209, and latch members 211 may then be rotated about the pin axis extending through lever pin 208 in a direction towards the distal end of receiver 200. During such rotation, interaction of safing cams 205 with camming surfaces 232 converts the rotational motion of lever 207 to linear or substantially linear motion of safing sector 203 away from axis B-B, moving track surface 287 out of alignment with bolt track 282. Further rotation of lever 207 towards the distal end of receiver 200 will further displace safing sector 203 away from axis B-B, until latch members 211 are aligned with first latch stops 217. At that point handle 211 may be released, at which time force from handle spring 221 will urge latch members 211 into engagement with first latch stops 217, thereby securing firearm safing assembly 201 in the safe position.

FIGS. 4A-4D depict various views of another example of a firearm safing assembly consistent with the present disclosure. As shown, firearm safing assembly 400 includes a latch 401, a safing sector 203, and a receiver safing door 404. The receiver safing door 404 is configured to mount to a receiver of a firearm, e.g., a rotary firearm such as the M-134. Like firearm safing assembly 201, firearm safing assembly 400 is generally configured to transition between a safe position and an armed position via substantially linear movement of safing sector 403 relative to a first axis extending through an opening of a receiver. Latch 401 includes latch members that extend through corresponding slots in safing sector 403 and into corresponding latch points in receiver safing door 404, to maintain safing sector 203 in the safe or armed position. In this embodiment, latch 401 is in the form of a handle that may be manipulated to engage and disengage the latch members from the latch points.

FIGS. 5A-5D depict various views of another example of a firearm safing assembly consistent with the present disclosure. As shown, firearm safing assembly 500 includes a latch 501, a safing sector 503, and a receiver safing door 504. The receiver safing door 504 is configured to mount to a receiver of a firearm, e.g., a rotary firearm such as the M-134. Like firearm safing assembly 201, firearm safing assembly 500 is generally configured to transition between a safe position and an armed position via substantially linear movement of safing sector 503 relative to a first axis extending through an opening of a receiver. Latch 501 includes a latch member (e.g., a toggle) that extend through a slot in safing sector 403 and into a corresponding latch point in receiver safing door 404, to maintain safing sector 203 in the safe or armed position. In this embodiment, latch is in the form of a rotary toggle or knob, which may include a spring to bias the latch member in a particular direction.

FIGS. 6A-6D depict various views of another example of a firearm safing assembly consistent with the present disclosure. As shown, firearm safing assembly 600 includes a latch 601, a safing sector 603, and a receiver safing door 604. The receiver safing door 604 is configured to mount to a receiver of a firearm, e.g., a rotary firearm such as the M-134. Like firearm safing assembly 201, firearm safing assembly 600 is generally configured to transition between a safe position and an armed position via substantially linear movement of safing sector 603 relative to a first axis extending through an opening of a receiver. Latch 601 includes first springs 610 which bias a catch 611 partially into a corresponding slot in receiver safing door 604 when firearm safing assembly 601 is in the armed position. At the same time, a portion of catch 611 is disposed within slot 613 within safing sector 603. Interference between the catch 611, safing sector 603 and receiver safing door 604 maintains the firearm safing assembly in the armed position. To transition from the armed position to the safe position, a button is depressed to compress spring 612. A first camming surface on the button interacts with a second camming surface on catch 611 and exerts a force sufficient to overcome the spring force of springs 610. As a result, catch 611 will move laterally into slot 613, eventually breaking the interference between catch 611 and receiver safing door 604. At that point safing sector 603 may be pulled upwards into the safe position.

Figure 7A:
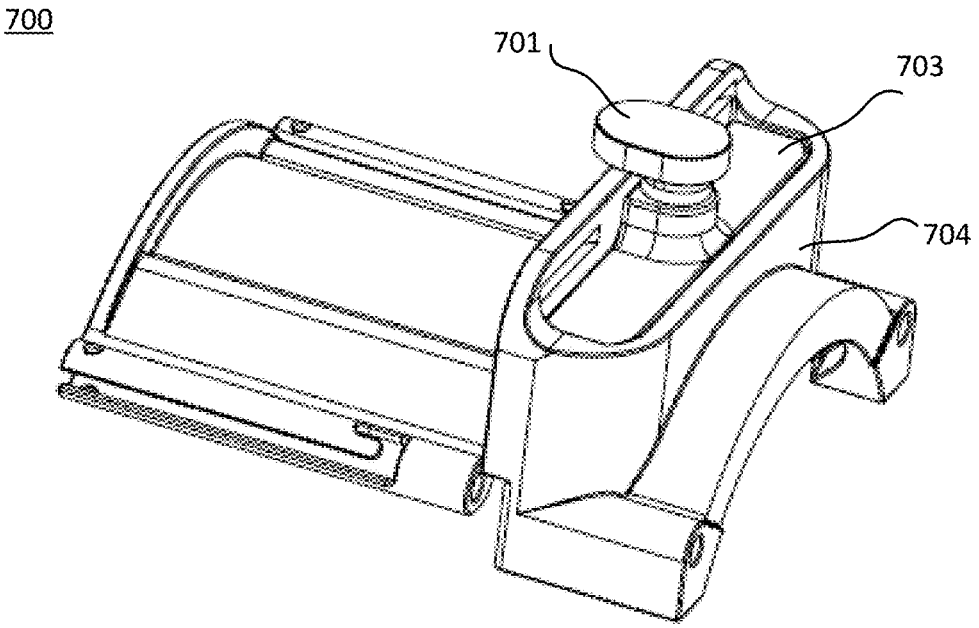
FIG. 7A is a right perspective view of another example firearm safing assembly consistent with the present disclosure.
Figure 7B:
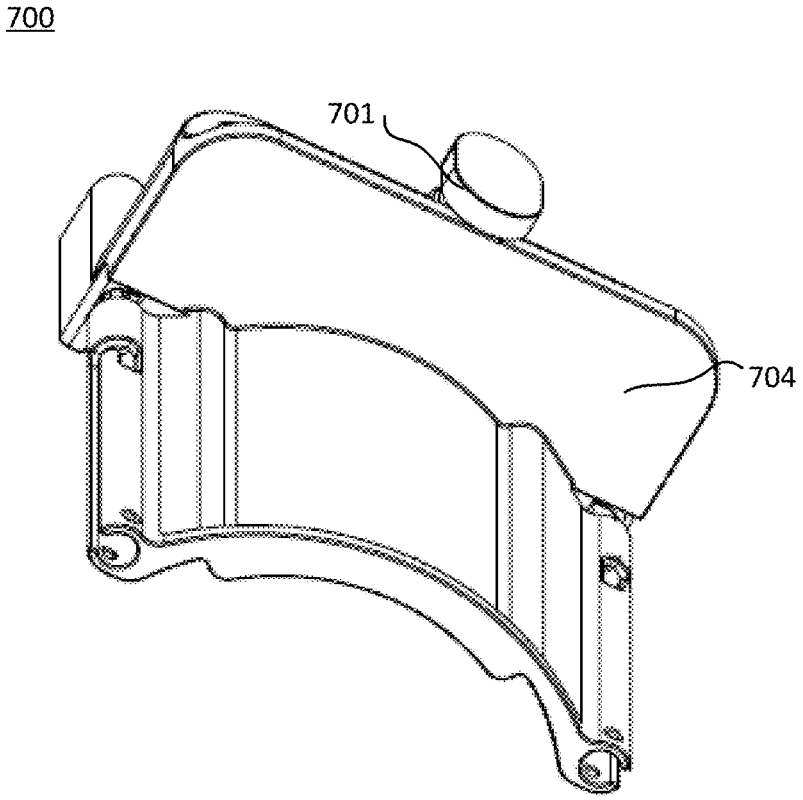
FIG. 7B is a rear perspective view of the example firearm safing assembly shown in FIG. 7A.
Figure 7C:
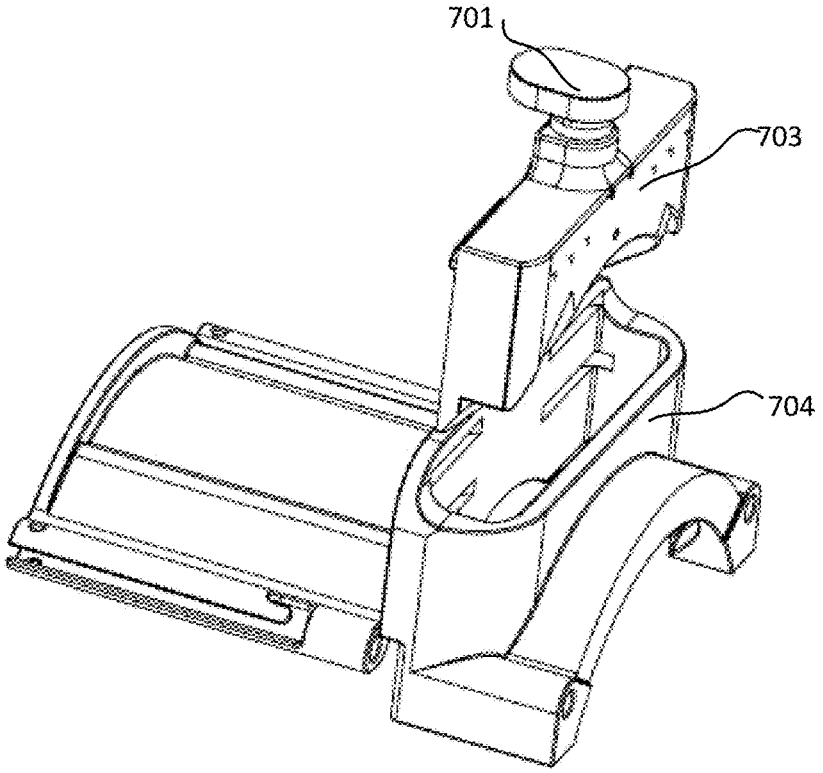
FIG. 7C is a first partial exploded view of the example firearm safing assembly shown in FIGS. 7A and 7B.
Figure 7D:
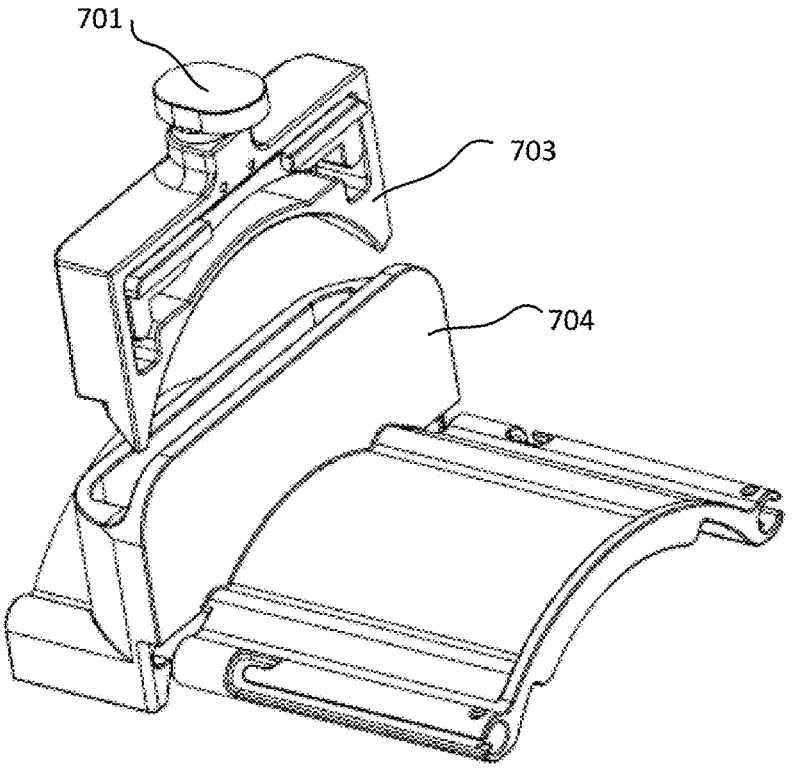
FIG. 7D is a second partial exploded view of the example firearm safing assembly shown in FIGS. 7A and 7B.
Figure 7E:
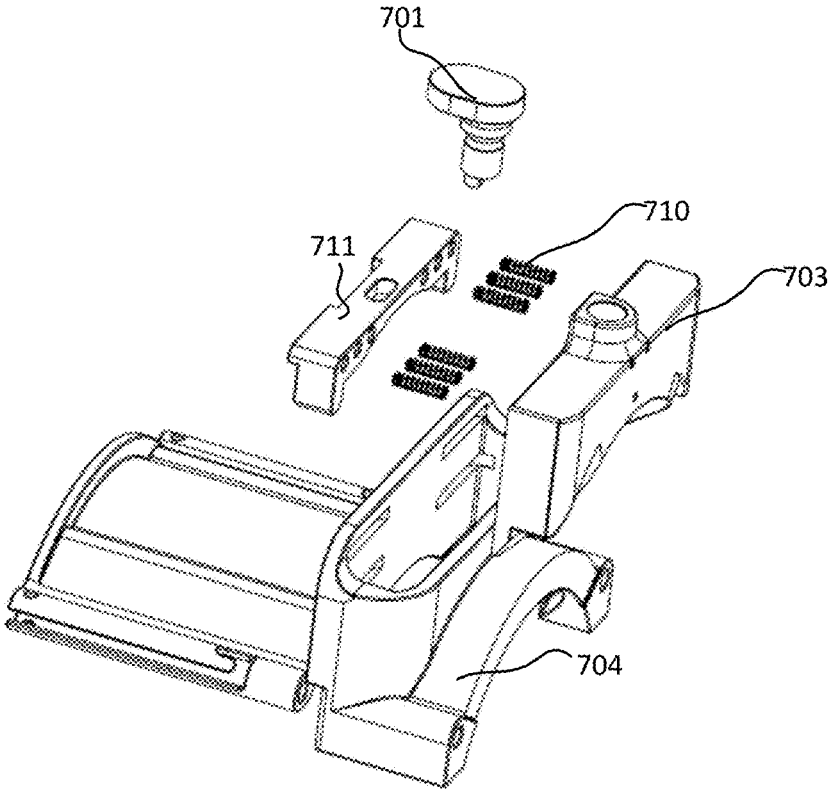
FIG. 7E is a first exploded view of the example firearm safing assembly shown in FIGS. 7A and 7B.
Figure 7F:
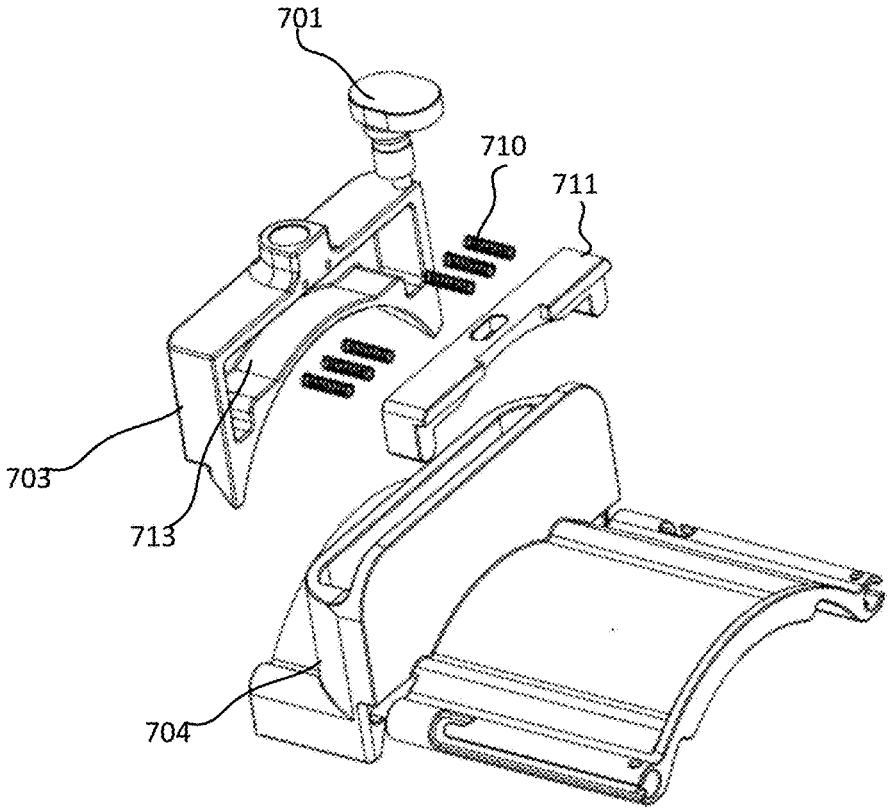
FIG. 7F is a second exploded view of the example firearm safing assembly shown in FIGS. 7A and 7B.
Figure 7G:
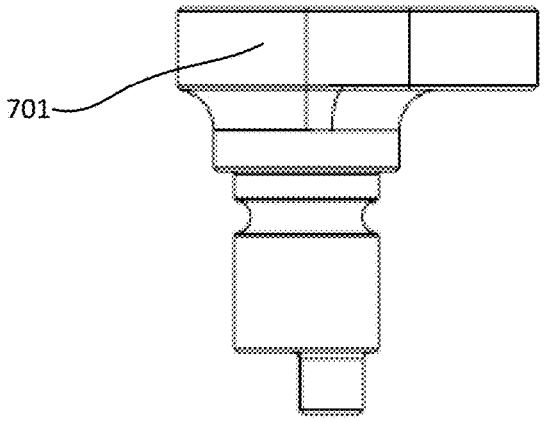
FIG. 7G is a side view of a latch used in the example firearm safing assembly shown in FIGS. 7A-7F.
Figure 7H:
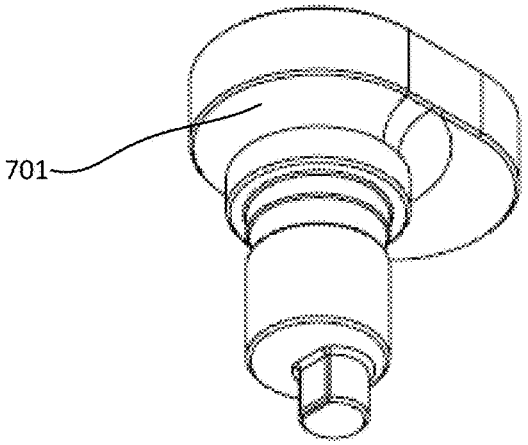
FIG. 7H is a bottom perspective view of the latch shown in FIG. 7G.
Figure 7I:
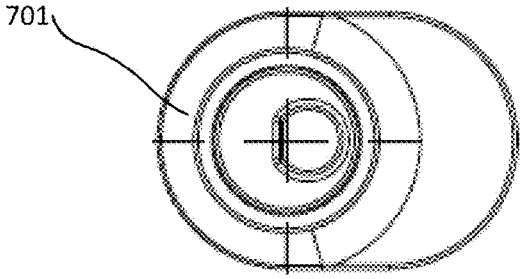
FIG. 7I is a bottom view of the latch shown in FIGS. 7G and 7H.

FIGS. 7A-6G depict various views of another example of a firearm safing assembly consistent with the present disclosure. As shown, firearm safing assembly 700 includes a latch 701, a safing sector 703, and a receiver safing door 704. The receiver safing door 704 is configured to mount to a receiver of a firearm, e.g., a rotary firearm such as the M-134. Like firearm safing assembly 201, firearm safing assembly 700 is generally configured to transition between a safe position and an armed position via substantially linear movement of safing sector 703 relative to a first axis extending through an opening of a receiver. Latch 701 includes springs 710 that bias catch 711 partially into one or more corresponding slots in receiver safing door 704 when firearm safing assembly 701 is in the armed position. At the same time, a portion of catch 711 is disposed within slot 713 within safing sector 703. Interference between the catch 711, safing sector 703 and receiver safing door 704 maintains the firearm safing assembly in the armed position. To transition from the armed position to the safe position, a latch 701 is twisted about an axis. Due to the eccentric shape of latch 701 (best shown in FIGS. 7G and 7H), force sufficient to overcome the spring force of springs 710 is exerted on catch 711. That urges catch 711 laterally into slot 713, eventually breaking the interference between catch 711 and receiver safing door 704. At that point safing sector 603 may be pulled upwards into the safe position.

EXAMPLES

Example 1: According to this example there is provided a firearm safing assembly including a safing sector including an inward facing surface, a track surface, and and a receiver door track, wherein: the receiver door track is configured to couple to a receiver of a rotatable firearm, wherein the receiver includes a bolt track and at least a portion of the receiver extends coaxially about a first axis; the safing sector is configured to be at least partially disposed within the receiver door track and to move between a safe position in which the inward facing surface is disposed toward the first axis and the track surface is substantially aligned with a first side of the bolt track and an unsafe position in which the inward facing surface is disposed away from the first axis and the track surface is out of alignment with the first side of the bolt track; during movement of the safing sector from the safe position to the armed position, the inward facing surface and the track surface move substantially linearly in a first direction that is substantially perpendicular to the first axis; and during movement of the safing sector from the armed position to the safe position, the inward facing surface and the track surface move substantially linearly in a second direction that is opposite or substantially opposite the first direction.

Example 2: This example includes any or all of the features of example 1, wherein the first axis extends through a center of an opening of the receiver.

Example 3: This example includes any or all of the features of example 2, wherein: the receiver door track includes a cam guide; the firearm safing assembly further includes a lever, a lever pin, and a safing cam; the safing cam is coupled to the safing sector and the lever; the lever is coupled to the cam guide by the lever pin, such that the lever is rotatable about a second axis extending through the lever pin; and the safing cam is configured to convert rotational movement of the lever about the second axis to linear movement of the safing sector relative to the first axis.

Example 4: This example includes any or all of the features of example 3, further including a first cam pin and a second cam pin, wherein: the safing cam is coupled to the lever by the first cam pin; and the safing cam is coupled to the safing sector by the second cam pin.

Example 5: This example includes any or all of the features of example 3 or example 4, wherein the safing sector further includes a camming surface that interacts with the safing cam as the safing sector is moved from the safe position to the armed position, and as the safing sector is moved from the armed position to the safe position.

Example 6: This example includes any or all of the features of any one of examples 3 to 5, wherein: the cam guide includes a first latch stop and a second latch stop; the firearm safing assembly further includes a latch handle coupled to the lever, the latch handle including a latch member; when the safing sector is in the safe position, at least a portion of the latch member is engaged within the first latch stop; and when the safing sector is in the armed position, at least a portion of the latch member is engaged within the second latch stop.

Example 7: This example includes any or all of the features of example 6, further including a lever spring, wherein: the lever spring biases the latch member towards the first latch stop when the safing sector is in the safe position; and the lever spring biases the latch member towards the second latch stop when the safing sector is in the armed position.

Example 8: This example includes any or all of the features of any one of examples 6 or 7, wherein: the lever includes a first handle pin slot; the latch handle further includes a second handle pin slot; the lever is coupled to the latch handle by a latch pin that extends at least partially through the first handle pin slot and the second handle pin slot; and the latch pin is movable within the first pin slot to allow engagement and disengagement of the latch member from the first and second latch stops.

Example 9: This example includes any or all of the features of any one of examples 4 to 8, wherein the receiver door track further includes a cover that is coupled to or integral with the cam guide.

Example 10: This example includes any or all of the features of example 9, wherein cover is integral with the cam guide.

Example 11: According to this example there is provided a machine gun, including: a receiver including a bolt track, at least a portion of the receiver extending coaxially about a first axis; and a firearm safing assembly including a safing sector including an inward facing surface, a track surface, and a receiver door track; wherein the receiver door track is coupled to the receiver; the safing sector is configured to be at least partially disposed within the receiver door track and to move between a safe position in which the inward facing surface is disposed towards the first axis and the track surface is substantially aligned with a first side of the bolt track, and an unsafe position in which the inward facing surface is disposed away from the first axis and the track surface is out of alignment with first side of the bolt track; during movement of the safing sector from the safe position to the armed position, the inward facing surface and the track surface move substantially linearly in a first direction that is substantially perpendicular to the first axis; and during movement of the safing sector from the armed position to the safe position, the inward facing surface and the track surface move substantially linearly in a second direction that is opposite or substantially opposite the first direction.

Example 12: This example includes any or all of the features of example 11, wherein the first axis extends through a center of an opening of the receiver.

Example 13: This example includes any or all of the features of example 12, wherein: the receiver door track includes a cam guide; the firearm safing assembly further includes a lever, a lever pin, and a safing cam; the safing cam is coupled to the safing sector and the lever; the lever is coupled to the cam guide by the lever pin, such that the lever is rotatable about a second axis extending through the lever pin; and the safing cam is configured to convert rotational movement of the lever about the second axis to linear movement of the safing sector relative to the first axis.

Example 14: This example includes any or all of the features of example 13, wherein the firearm safing assembly further includes a first cam pin and a second cam pin, wherein: the safing cam is coupled to the lever by the first cam pin; and the safing cam is coupled to the safing sector by the second cam pin.

Example 15: This example includes any or all of the features of example 13 or 14, wherein the safing sector further includes a camming surface that interacts with the safing cam as the safing sector is moved from the safe position to the armed position, and as the safing sector is moved from the armed position to the safe position.

Example 16: This example includes any or all of the features of any one of examples 13 to 15, wherein: the cam guide includes a first latch stop and a second latch stop; the firearm safing assembly further includes a latch handle coupled to the lever, the latch handle including a latch member; when the safing sector is in the safe position, at least a portion of the latch member is engaged within the first latch stop; and when the safing sector is in the armed position, at least a portion of the latch member is engaged within the second latch stop.

Example 17: This example includes any or all of the features of example 16, further including a lever spring, wherein: the lever spring biases the latch member towards the first latch stop when the safing sector is in the safe position; and the lever spring biases the latch member towards the second latch stop when the safing sector is in the armed position.

Example 18: This example includes any or all of the features of example 16 or example 17, wherein: the lever includes a first handle pin slot; the latch handle further includes a second handle pin slot; the lever is coupled to the latch handle by a latch pin that extends at least partially through the first handle pin slot and the second handle pin slot; and the latch pin is movable within the first pin slot to allow engagement and disengagement of the latch member from the first and second latch stops.

Example 19: This example includes any or all of the features of any one of examples 14 to 18, wherein the receiver door track further includes a cover that is coupled to or integral with the cam guide.

Example 20: This example includes any or all of the features of example 17, wherein cover is integral with the cam guide.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed is:

1. A firearm safing assembly comprising a safing sector comprising an inward facing surface, a track surface, and a receiver door track, wherein:

the receiver door track is configured to couple to a receiver of a rotatable firearm, wherein the receiver comprises a bolt track and at least a portion of the receiver extends coaxially about a first axis;

the safing sector is configured to be at least partially disposed within the receiver door track and to move between a safe position and an armed position; and the firearm safing assembly is configured such that:

during movement of the safing sector from the safe position to the armed position, the inward facing surface and the track surface move substantially linearly in a first direction that is substantially perpendicular to the first axis; and during movement of the safing sector from the armed position to the safe position, the inward facing surface and the track surface move substantially linearly in a second direction that is opposite or substantially opposite the first direction.

2. The firearm safing assembly of claim 1, wherein said first axis extends through a center of an opening of said receiver.

3. The firearm safing assembly of claim 2, wherein:

the receiver door track comprises a cam guide;

the firearm safing assembly further comprises a lever, a lever pin, and a safing cam;

the safing cam is coupled to the safing sector and the lever;

the lever is coupled to the cam guide by the lever pin, such that the lever is rotatable about a second axis extending through the lever pin; and the safing cam is configured to convert rotational movement of the lever about said second axis to linear movement of said safing sector relative to said first axis.

4. The firearm safing assembly of claim 3, further comprising a first cam pin and a second cam pin, wherein:

the safing cam is coupled to the lever by the first cam pin; and the safing cam is coupled to the safing sector by the second cam pin.

5. The firearm safing assembly of claim 3, wherein the safing sector further comprises a camming surface that interacts with said safing cam as the safing sector is moved from the safe position to the armed position, and as the safing sector is moved from the armed position to the safe position.

6. The firearm safing assembly of claim 3, wherein:

the cam guide comprises a first latch stop and a second latch stop;

the firearm safing assembly further comprises a latch handle coupled to the lever, the latch handle comprising a latch member;

when the safing sector is in the safe position, at least a portion of the latch member is engaged within the first latch stop; and when the safing sector is in the armed position, at least a portion of the latch member is engaged within the second latch stop.

7. The firearm safing assembly of claim 6, further comprising a lever spring, wherein:

the lever spring biases the latch member towards the first latch stop when the safing sector is in the safe position; and the lever spring biases the latch member towards the second latch stop when the safing sector is in the armed position.

8. The firearm safing assembly of claim 6, wherein:

the lever comprises a first handle pin slot;

the latch handle further comprises a second handle pin slot;

the lever is coupled to the latch handle by a latch pin that extends at least partially through the first handle pin slot and the second handle pin slot; and the latch pin is movable within the first pin slot to allow engagement and disengagement of the latch member from the first and second latch stops.

9. The firearm safing assembly of claim 1, wherein in the safe position the inward facing surface of the safing sector is disposed away from the first axis and the track surface is out of alignment with a first side of said bolt track.

10. The firearm safing assembly of claim 1, wherein in the armed position the inward facing surface of the safing sector is disposed toward the first axis and the track surface is substantially aligned with a first side of said bolt track.

11. A machine gun, comprising:

a receiver comprising a bolt track, at least a portion of the receiver extending coaxially about a first axis; and a firearm safing assembly comprising a safing sector comprising an inward facing surface, a track surface, and a receiver door track; wherein the receiver door track is coupled to the receiver;

the safing sector is configured to be at least partially disposed within the receiver door track and to move between a safe position and an armed position; and the firearm safing assembly is configured such that:

during movement of the safing sector from the safe position to the armed position, the inward facing surface and the track surface move substantially linearly in a first direction that is substantially perpendicular to the first axis; and during movement of the safing sector from the armed position to the safe position, the inward facing surface and the track surface move substantially linearly in a second direction that is opposite or substantially opposite the first direction.

12. The machine gun of claim 11, wherein said first axis extends through a center of an opening of said receiver.

13. The machine gun of claim 12, wherein:

the receiver door track comprises a cam guide;

the firearm safing assembly further comprises a lever, a lever pin, and a safing cam;

the safing cam is coupled to the safing sector and the lever;

the lever is coupled to the cam guide by the lever pin, such that the lever is rotatable about a second axis extending through the lever pin; and the safing cam is configured to convert rotational movement of the lever about said second axis to linear movement of said safing sector relative to said first axis.

14. The machine gun of claim 13, wherein the firearm safing assembly further comprises a first cam pin and a second cam pin, wherein:

the safing cam is coupled to the lever by the first cam pin; and the safing cam is coupled to the safing sector by the second cam pin.

15. The machine gun of claim 13, wherein the safing sector further comprises a camming surface that interacts with said safing cam as the safing sector is moved from the safe position to the armed position, and as the safing sector is moved from the armed position to the safe position.

16. The machine gun of claim 13, wherein:

the cam guide comprises a first latch stop and a second latch stop;

the firearm safing assembly further comprises a latch handle coupled to the lever, the latch handle comprising a latch member;

when the safing sector is in the safe position, at least a portion of the latch member is engaged within the first latch stop; and when the safing sector is in the armed position, at least a portion of the latch member is engaged within the second latch stop.

17. The machine gun of claim 16, further comprising a lever spring, wherein:

the lever spring biases the latch member towards the first latch stop when the safing sector is in the safe position; and the lever spring biases the latch member towards the second latch stop when the safing sector is in the armed position.

18. The machine gun of claim 16, wherein:

the lever comprises a first handle pin slot;

the latch handle further comprises a second handle pin slot;

the lever is coupled to the latch handle by a latch pin that extends at least partially through the first handle pin slot and the second handle pin slot; and the latch pin is movable within the first pin slot to allow engagement and disengagement of the latch member from the first and second latch stops.

19. The machine gun of claim 11, wherein in the safe position the inward facing surface of the safing sector is disposed away from the first axis and the track surface is out of alignment with the first side of said bolt track.

20. The machine gun of claim 11, wherein in the armed position the inward facing surface of the safing sector is disposed toward the first axis and the track surface is substantially aligned with a first side of said bolt track.

* * * * *